US012296276B2

(12) United States Patent
Pieters et al.

(10) Patent No.: US 12,296,276 B2
(45) Date of Patent: May 13, 2025

(54) LITTLE GENIUS PRODUCING PUZZLES

(71) Applicants: Magdalena Henrietta Elizabetha Pieters, Pretoria (ZA); Lize Joey Mai Johnston, Los Angeles, CA (US)

(72) Inventors: Magdalena Henrietta Elizabetha Pieters, Pretoria (ZA); Lize Joey Mai Johnston, Los Angeles, CA (US)

( * ) Notice: Subject to any disclaimer, the term of this patent is extended or adjusted under 35 U.S.C. 154(b) by 239 days.

(21) Appl. No.: 16/594,002

(22) Filed: Oct. 5, 2019

(65) Prior Publication Data

US 2020/0108307 A1 Apr. 9, 2020

Related U.S. Application Data

(63) Continuation-in-part of application No. 15/988,185, filed on May 24, 2018, now abandoned.
(Continued)

(51) Int. Cl.
*A63F 9/10* (2006.01)
*A63F 3/04* (2006.01)
*A63F 9/06* (2006.01)

(52) U.S. Cl.
CPC ..... *A63F 9/10* (2013.01); *A63F 3/04* (2013.01); *A63F 3/0415* (2013.01);
(Continued)

(58) Field of Classification Search
CPC ..... A63F 9/10; A63F 9/1044; A63F 9/0666; A63F 3/04; A63F 3/0415; A63F 9/1011;
(Continued)

(56) References Cited

U.S. PATENT DOCUMENTS 609,347 A * 8/1898 Holzhausen ..... A63F 9/10
273/157 R
1,359,646 A * 11/1920 Zion ..... A63F 9/18
434/322

(Continued)

FOREIGN PATENT DOCUMENTS

GB 403432 A * 12/1933
GB 1565336 A * 4/1980

(Continued)

OTHER PUBLICATIONS

"Tens and Ones", <http://www.onlinemathlearning.com/tens-and/ones.html>, dated Jun. 12, 2017, retrieved on Jul. 10, 2019, pp. 1-6. (Year: 2017).*

*Primary Examiner* — Steven B Wong
(74) *Attorney, Agent, or Firm* — Lambert Shortell & Connaughton; David J. Connaughton, Jr.; Justin P. Tinger

(57) ABSTRACT

A series of educational multi-layered jigsaw puzzles based on the K-12 school curriculum in which puzzles progress in difficulty and pieces have liquid freeform cut lines, cut along the outlines or silhouette of the image, with puzzle pieces getting progressively smaller from top to bottom creating a tiered basin when all pieces are removed, where some layers are interchangeable and some are double-sided. In mathematical puzzles, the change of state from single to double digits is illustrated with a change of object, where the double-digit object is one that would consist of multiple instances of the single-digit object in real life, such as grapes and bunches, and pieces are non-geometrical, non-polygonal, non-spherical and purposefully difficult to distinguish by shape alone.

4 Claims, 20 Drawing Sheets

Related U.S. Application Data

Figure 1:
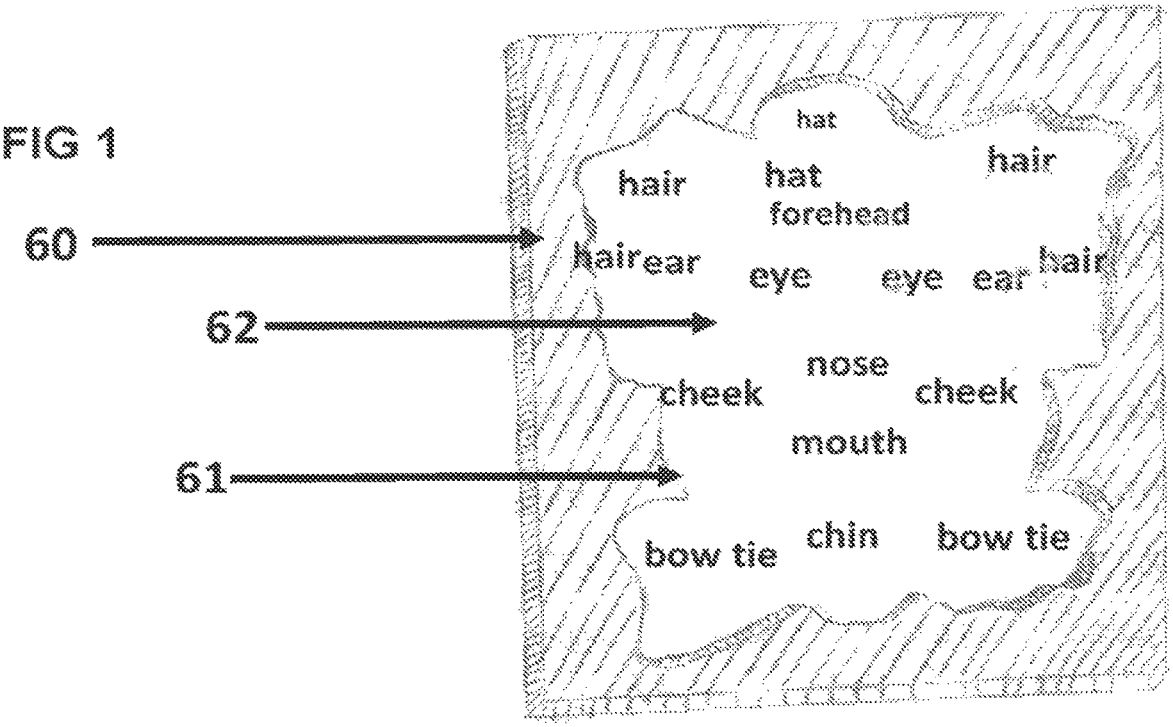

(60) Provisional application No. 62/521,729, filed on Jun. 19, 2017.

(52) U.S. Cl.
CPC ..... *A63F 9/0666* (2013.01); *A63F 9/1011* (2013.01); *A63F 9/1044* (2013.01)

(58) Field of Classification Search
CPC ..... A63F 2009/1005; A63F 2009/1083; A63F 2009/1088
See application file for complete search history.

(56) References Cited

U.S. PATENT DOCUMENTS 1,396,379 A * 11/1921 Le Roy ..... G09B 1/10 434/345
1,443,217 A * 1/1923 Dodd ..... A63H 33/044 446/75
1,709,660 A * 4/1929 De Bracht ..... A63F 9/1204 273/157 R
1,964,007 A * 6/1934 Parks ..... A63F 9/12 273/157 R
2,199,499 A * 5/1940 Kreitler ..... A63F 3/0434 273/273
2,647,330 A * 8/1953 Morris ..... A63F 9/10 434/304
2,738,594 A * 3/1956 Swingle ..... A63H 33/04 446/85
2,971,275 A * 2/1961 Provenzano ..... A63F 3/0415 434/191
3,290,798 A * 12/1966 Gilbert ..... G09B 19/02 434/191
3,302,310 A * 2/1967 Leven ..... G09B 17/00 434/171
3,410,021 A * 11/1968 Patterson ..... A63H 33/04 446/78
3,491,196 A * 1/1970 Stein ..... A63F 9/0098 434/167
3,495,833 A * 2/1970 Wesley ..... A63F 9/10 434/150
3,647,218 A * 3/1972 Foley ..... A63F 9/12 273/157 R
3,909,003 A * 9/1975 Rabinovich ..... A63F 9/10 273/287
4,044,476 A * 8/1977 Marsh ..... A63F 9/0001 434/171
4,336,020 A * 6/1982 Zacharin ..... A63F 9/10 273/157 R
4,486,018 A * 12/1984 Keller, Jr. ..... A63F 9/1044 220/377
4,518,358 A * 5/1985 Mather ..... G09B 19/02 434/195
4,719,656 A * 1/1988 Godinet ..... A47C 27/001 446/268
4,808,111 A * 2/1989 Pratt ..... G09B 1/06 434/191
4,815,742 A * 3/1989 Augustine ..... A63F 9/0613 273/157 A
5,040,987 A * 8/1991 Frazier ..... G09B 1/06 434/188
5,062,637 A * 11/1991 Bianchi ..... A63F 9/10 273/157 R
5,149,098 A * 9/1992 Bianchi ..... A63F 9/10 273/157 R
5,203,706 A * 4/1993 Zamir ..... G09B 1/16 434/159
5,362,054 A * 11/1994 Ashemimry ..... A63F 9/10 273/157 R
5,529,497 A * 6/1996 Bigold ..... G09B 1/02 434/191
5,573,246 A * 11/1996 Liao ..... A63F 9/12 273/157 R
5,813,154 A * 9/1998 Wilford ..... G09F 7/04 273/157 R
6,672,588 B1 * 1/2004 Kielar ..... A63F 9/10 273/157 R
6,685,186 B2 * 2/2004 Wilson ..... A63F 9/12 273/157 R
6,702,586 B1 * 3/2004 Miller ..... A63F 9/10 273/157 R
7,631,870 B1 * 12/2009 Bennett ..... A63F 9/10 273/157 R
8,573,596 B2 * 11/2013 Gearty ..... A63F 9/10 273/157 R
9,403,084 B2 * 8/2016 Klemm ..... A63F 9/0666
2004/0032080 A1 * 2/2004 Wells ..... A63F 9/10 273/157 R
2005/0253336 A1 * 11/2005 Schwartz ..... A63F 9/10 273/157 R
2008/0136099 A1 * 6/2008 Frost ..... G09B 1/36 273/157 R
2013/0175757 A1 * 7/2013 Wu ..... A63F 9/10 273/157 R
2013/0328265 A1 * 12/2013 Wu ..... A63F 9/001 273/157 R
2014/0206423 A1 * 7/2014 Weed ..... A63F 3/0478 463/9
2015/0209661 A1 * 7/2015 Klemm ..... A63F 9/10 273/157 R
2017/0296912 A1 * 10/2017 Gair ..... A63F 9/10

FOREIGN PATENT DOCUMENTS

KR 200308014 Y1 * 3/2003
KR 200401237 Y1 * 11/2005

* cited by examiner

Number Concepts: 0 - 29

FIG 17 Example Table : CAPS South Africa curriculum objectives translated to Puzzle Themes

| No | Title | Subject | Stage in curriculum taught |
|---|---|---|---|
| 1 | What's the time? | | Grade 1 (Year 1) Term 1 week 4,5, Grade 2 (Year 2) week 5,6, Grade 3 (Year 3) Term 2, term 4 week 1 |
| 2 | Century puzzle (Number patterns): | Math | Year 1 Term 1 week 1,2, 3, Term 2 week 2, 5, Term 3 Week 1,2, Term 4 week 1,2, Year 2 Term 1 week 1,3, 4, Year 2 Term 2 Week 1,2,5, 8, Year 2 term 3 week 1, Year 2 Term 4 Week 1,2, 3 Year 3 Term 1 week 6, 7, Year 3 term 2 week 5, Year 3 term 4 week 1, Year 3 term 4 Week 2, Year 4 term 1 week 1, 2, Year 4 term 4 week 1,2,3,4 (Public comments) |
| 3 | Fractions: | Math | Year 1 Term 2 week 4,5 Term 4 week 3,4, Year 2 term 2 week 3, 4, Year 2 Term 4 week 8. Year 3 term 1 week 6 Year 3 Term 2 Week 1, Year 4 term 1 week 5,6 Year 4 term 2 week 1,2, Year 4 term 4 week 1,2,3,4 |
| 4 | Not a puzzle | | |
| 6 | Numbers concepts: | All of them, also 1 million, as well as games | Year 1 Term 1 week 1, 2,3 Term 2 week 2, Term 3 Week 1,2, Term 4 week 1, Year 2 Term 1 week 1,3, Year 2 Term 2 Week 1, 2, 3,8, Year 2 term 3 week 1, Year 2 Term 4 Wek 1,2, 3 Year 3 term 1 week 1,2,3,4,5,6, Year 3 term 2 Week 1,2, Year 3 term 2 week 5, Year 3 term 3 week 1, Year 3 term 4 week 1, Year 4 term 1 week 1, 2, Year 4 term 4 week 1,2,3,4 (Public comments) |
| 7 | Numerical Transactions: | Math | Year 1 Term 1 week 1, 2,3, Term 2 week 1,2, Term 3 Week 1,2, Term 4 week 1, Year 2 Term 1 week 1,3, Year 2 Term 2 Week 1,2, 3,8, Year 2 term 3, week 1, Year 2 Term 4 Week 1,2, 3 Year 3 term 1 week 1,2,3,4,5,6 ear 3 term 2 Week 1,2, Year 3 term 2 week 5, Year 3 term 3 week 1, Year 3 term 4 week 1, Year 4 term 1 week 1, 2, Year 4 term 4 week 1,2,3,4 (Public comments) |
| 8 ,9 | Not puzzles | | |

FIG. 17 (continued)

| | | | |
|---|---|---|---|
| 10 | Reading puzzles: | Virtually all the puzzles are also Reading puzzles, as they have words in them. We need to start with basics Double Alphabet;<br>Clown;<br>My Bedroom;<br>My wonderful Body;<br>This is where I live;<br>I'm getting clever (My School),<br>but then do not withhold learner enjoys.<br><br>Also, the following:<br>Our Anthem;<br>Ways we communicate, etc. etc | Provides & can be used for listening & speaking, and Also Reading & phonics in all foundation phase grades throughout the learning process, i.e., for Home Language, FAL as well as SAL.<br>It uses pictures talk, is self-correcting.<br>Great for group Reading, paired Reading or individual Also Reading.<br>Encourages repetition.<br>Stimulates & facilitates word recognition, encourages discussion, evaluation and appreciation, overcome barriers to learning in a natural relaxed way, is integrated with the learner's reality, play based. It develops fine motor control and spatial relation, constitutes informal and spontaneous learning.<br>Can be teacher-guided, routine or child-initiated, or free play. It serves the five main components to the teaching of Reading:<br>* Phonemic awareness;<br>* Word Recognition (Sight Words & Phonics);<br>* Comprehension;<br>*Vocabulary;<br>*Fluency.<br><br>The following applies to every Reading puzzle. The clown is used as an example of illustration:<br>Clown with home language words + FAL;<br>Three layers of puzzle plus the tray.<br>Useful educational aid in all three levels:<br>Grade R, 1,2 and 3 learning language;<br>Grade R, 1,2 and 3 learning reading in emergent reading skills and shared reading as class with teacher.<br>Grade R:<br>Term 1: "Solves and completes at least 5 jig saw puzzles"<br>"Uses visual and pictorial cues to make meaning"<br>"Matches words to words on objects and named items such as name cards on tables, door, window"<br>"Relates sounds to letters and words"<br>"Creative art activities and music rings are ideal opportunities for the development of fine motor skills" such as puzzle building; |

FIG. 17 (continued)

| | | | |
|---|---|---|---|
| | | | Term 2: "Works with words<br>Term 3: Listening & Speaking (ORAL)<br>CONTENT/CONCEPTS/SKILLS<br>"Talks about pictures in posters, theme charts, books etc. related to a minimum of five themes per term"<br>"Uses language to develop concepts"<br>"Uses language to investigate and explore: Solves and completes ten or more-piece jig-saw puzzles"<br>"Uses visual and pictorial cues to make meaning:<br>Understands that pictures and photographs convey meaning about events, people, places and things<br>Talk about these.<br>Looks carefully at pictures and talks about common experiences<br>isolates images from the foreground and background in pictures and simple designs<br>Distinguishes between the shape of different letters and words (e.g. 'c' and 'a')<br>Completes between ten- and twenty-piece jig-saw puzzles<br>independent Reading Phonological/Phonemic Awareness: Many of the sound activities listed<br>below could be introduced during routines and rings<br>"Relates sounds to letters and words:<br>Recognizes aurally and visually some initial consonants and vowels especially at the beginning of<br>words.<br>Recognizes sounds at the beginning of some words: friends' names or names of animals<br>Term 3: Emergent Handwriting: Helps to develop fine motor skills and hand-eye coordination<br>Content/Concepts/Skills:<br>Discussing the pictures on the puzzle and weaving a story around it;<br>Working with words |

FIG. 17 (continued)

| | | | |
|---|---|---|---|
| | | | Term 4: Uses language to develop concepts seen in the puzzles in all subjects such as quantity, size, shape, direction, color, speed, time, age and sequence<br>Uses language to think and reason<br>Identifies and describes similarities and differences<br>Matches things that go together, and compares things that are different<br>Classifies things according to own criteria and more complex criteria such as textures<br>Identifies parts from the whole in a 2-Dimensional format and constructs in 3-Dimensional format. Copies a picture or a pattern from a card (2-D) using blocks or plastic shapes (3-D)<br>Uses language to investigate and explore<br>Asks questions and looks to the puzzles for explanations<br>Listens to problems and offers solutions<br>Completes 20 piece or more jig-saw puzzles<br>Processes information:<br>Picks out selected information from an oral description. For example, listens for the starting time of an event from an announcement<br>Matches words to pictures in print such as word-picture puzzles<br>Interprets pictures to construct ideas. For example, makes up own story and 'Read' the Pictures.<br>Distinguishes pictures from print. For example, points to a word and asks for it to be read.<br><br>Grade1:<br>Term1: Reading and Phonics; Daily Reading, Shared Reading; Group Guided Reading; Develop fine motor control, hand-eye coordination<br>Term 2: Listening and speaking, Content/Concepts/Skills- by discussing the puzzle pictures, etc. |

FIG. 17 (continued)

| | | | |
|---|---|---|---|
| | | | Week 1 – 5 and Week 6 – 10<br>Phonemic awareness discussing the sounds pf the words on the puzzles<br><br>Term 3: The same as above: week 1-5, 6 – 10.<br>Term 4: The same as above<br><br>Grade 2:<br>Term 1: Listening and Speaking, Reading and Phonics, Writing<br>Term 2: As for above<br>Term 3: As for above: week 1-5, 6-10<br>Term 4: as for above<br>Grade 3: Term 1 – 4 As for above. |
| | | | |
| 11 | This is where I live | See Also Reading Puzzles | See Also Reading Puzzles |
| 12 | I'm getting clever (My School) | See Also Reading Puzzles | See Also Reading Puzzles |
| 13 | Colours | See Also Reading Puzzles | Grade R Term 1, Term 2, Beginning Knowledge and Personal and Social Well-being; |
| 14 | Days of the week | See Also Reading Puzzles | Grade R Term 1, Term 2: Beginning Knowledge and Personal and social well-being |
| 15 | Seasons/activities | See Also Reading Puzzles | Grade R Term 1, Term 2: Beginning Knowledge and Personal and social well-being |
| 16 | Good habits | See Also Reading Puzzles | Grade R Term 1, Term 2: Beginning Knowledge and Personal and social well-being |
| 17 | Ship shapes | See Also Reading Puzzles | Grade R Term 1, Term 2: Beginning Knowledge and Personal and social well-being |
| 18 | My Family | See Also Reading Puzzles | Grade R Term 1, Term 2: Beginning Knowledge and Personal and social well-being and later in curriculum |
| 19 | Inside my ears | | Grade R Term 1, Term 2: Beginning Knowledge and Personal and social well-being and later in curriculum |
| 20 | My wonderful eyes | See Also Reading Puzzles | Grade R Term 1, Term 2: Beginning Knowledge and Personal and social well-being and later in curriculum |
| 21 | Transport methods | Road, Rail, Air, water. Uses | Grade R Term 1, Term 2: Beginning Knowledge and Personal and social well-being and later in curriculum<br>Grade 2 Term 2, 3 |
| 22 | Who does what? | See Also Reading Puzzles | Grade R Term 1, Term 2: Beginning Knowledge and Personal and social well-being and later in curriculum |

FIG. 17 (continued)

| | | | |
|---|---|---|---|
| 23 | Tasty Juicy Fruit | See Also Reading Puzzles | Grade R Term 1, Term 2: Beginning Knowledge and Personal and social well-being and later in curriculum |
| 24 | Farm Animals | See Also Reading Puzzles | Grade R Term 1, Term 2: Beginning Knowledge and Personal and social well-being and later in curriculum |
| 25 | Dairy Farming | See Also Reading Puzzles | Grade R Term 1, Term 2: Beginning Knowledge and Personal and social well-being and later in curriculum |
| 26 | Where did Mon get my jersey? | See Also Reading Puzzles | Grade R Term 1, Term 2: Beginning Knowledge and Personal and social well-being and later in curriculum |
| 27 | Polluting & Recycling | See Also Reading Puzzles | Grade R Term 1, Term 2: Beginning Knowledge and Personal and social well-being and later in curriculum |
| 28 | bird puzzles | Three. See Also Reading Puzzles | Grade R Term 1, Term 2: Beginning Knowledge and Personal and social well-being and later in curriculum |
| 29 | The Bird (anatomy) | See Also Reading Puzzles | Grade R Term 1, Term 2: Beginning Knowledge and Personal and social well-being and later in curriculum |
| 30 | Reptiles | See Also Reading Puzzles | Grade R Term 1, Term 2: Beginning Knowledge and Personal and social well-being and later in curriculum |
| 31 | Dinosaurs | See Also Reading Puzzles | Grade R Term 1, Term 2: Beginning Knowledge and Personal and social well-being and later in curriculum |
| 32 | Wild Animals | Types, camouflage | Grade R Term 1, Term 2: Beginning Knowledge and Personal and social well-being and later in curriculum<br>Grade 2 Term 2 |
| 33 | Sports | See Also Reading Puzzles | Grade R Term 1, Term 2: Beginning Knowledge and Personal and social well-being and later in curriculum |
| 34 | Left Right Dolls and Left Right letters | See Also Reading Puzzles | Grade R Term 1, Term 2: Beginning Knowledge and Personal and social well-being and later in curriculum |
| 35 | I learn safely at home | See Also Reading Puzzles | Grade 1 Term 1 |
| 36 | My wonderful Body; | (Also Reading puzzles & Anatomy: Heart, eyes, ears, See Also Reading Puzzles | Grade 1 Term 1, And later |
| 37 | Pets | See Also Reading Puzzles | Grade 1 Term 3 |
| 38 | My Community | See Also Reading Puzzles | Grade 1 Term 3 |
| 39 | Manners & Responsibilities | See Also Reading Puzzles | Grade 1 Term 3 |
| 40 | Plants & Seeds | See Also Reading Puzzles | Grade 1 Term 3 |
| 41 | Foods we eat | See Also Reading Puzzles | Grade 1 Term 4 |
| 42 | Houses | Types. See Also Reading Puzzles | Grade 1 Term 4 |
| 43 | Picture map of My community | | Grade 1 Term 4 |
| 44 | Water | | Grade 1 Term 4 |
| 45 | The starry sky | See Also Reading Puzzles | Grade 1 Term 4 |
| 46 | The Moon | See Also Reading Puzzles | Grade 1 Term 4 |

FIG. 17 (continued)

| | | | |
|---|---|---|---|
| 47 | My wonderful Body. | Heart, Eyes, etc. Also Phys Ed Creative Arts. See Also Reading Puzzles | Grade 1 Term 1,2,3,4 |
| 48 | Shape blocks | See Also Reading Puzzles | Grade Term 1 |
| 49 | Left Right (Laterality) | See Also Reading Puzzles | Grade 1 Term 1, 2, 3 |
| 50 | Seasons | See Also Reading Puzzles | Grade 2 Term 2 |
| 51 | Farm Animals: | Types, uses. See Also Reading Puzzles. See Also Reading Puzzles | Grade 2 Term 2 |
| 52 | Animals living in water: fresh, salt | See Also Reading Puzzles | Grade 2 Term 2 |
| 53 | Animal homes | See Also Reading Puzzles | Grade 2 Term 2 |
| 54 | Soil types | See Also Reading Puzzles | Grade 2 Term 3 (Beginning knowledge) |
| 55 | Creatures living in soil | See Also Reading Puzzles | Grade 2 Term 3 |
| 56 | Vegetables | | Grade 2 Term 3 |
| 57 | Road safety: Rules | See Also Reading Puzzles | Grade 2 Term 3 |
| 58 | Road Safety: Signs | See Also Reading Puzzles | Grade 2 Term 3 |
| 59 | People who help us: | How to use and ask for help. See Also Reading Puzzles | Grade 2 Term 3 |
| 60 | Map of SA | See Also Reading Puzzles | Grade 2 Term 4 |
| 61 | Antheim | See Also Reading Puzzles | Grade 2 Term 4 |
| 62 | Our National Flag | | Grade 2 Term 4 |
| 63 | Ways we communicate | See Also Reading Puzzles | Grade 2 Term 4 |
| 64 | Healthy eating: | Food groups; Vitamins, proteins, etc. See Also Reading Puzzles | Grade 3 Term 2 |
| 65 | Insects: | Types. See Also Reading Puzzles | Grade 3 Term 2 |
| 66 | Life cycles: | mammals, insects, amphibians, Birds. See Also Reading Puzzles | Grade 3 Term 2 |
| 67 | Recycling | See Also Reading Puzzles | Grade 3 Term 2 |
| 68 | Inside our earth | See Also Reading Puzzles | Grade 3 Term 2 |
| 69 | Earth from space; | Names of planets. See Also Reading Puzzles | Grade 3 Term 2 |
| 70 | Inside an egg | See Also Reading Puzzles | Grade R Term 1, Term 2: Beginning Knowledge and Personal and social well-being and later in curriculum Grade 3 Term 2 |
| 71 | Beautiful flower | See Also Reading Puzzles | Grade 1 Term 3 |

LITTLE GENIUS PRODUCING PUZZLES

(b) CROSS-REFERENCE TO RELATED APPLICATIONS

Provisional USA Patent US62/521,729: Filed by MHE Pieters on Jun. 19, 2017; Confirmation no. 7806. Non-Provisional USA Patent Application 15.988/185 filed on 24 May 2018, confirmation no. 7327.

(c) STATEMENT REGARDING FEDERALLY SPONSORED RESEARCH OR DEVELOPMENT

Not Applicable.

(d) THE NAMES OF PARTIES TO A JOINT RESEARCH AGREEMENT

Not Applicable.

(e) INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Provisional USA Patent US62/521,729: Filed by MHE Pieters on Jun. 19, 2017; Confirmation no. 7806. Non-Provisional USA Patent Application 15.988/185 filed on 24 May 2018, confirmation no. 7327.

(f) STATEMENT REGARDING PRIOR DISCLOSURES BY THE INVENTOR OR A JOINT INVENTOR

Not Applicable.

(g) BACKGROUND OF THE INVENTION

(1) Field of the Invention

Approximately 4 billion people in the world today are functionally illiterate, which stunts their growth and learning for the rest of their lives. Illiteracy causes shame and embarrassment, which prevents and discourages honesty about the condition and further ensures that the condition remains unchanged. These puzzles are intended to make a massive contribution towards alleviating this situation, because the "Little Genius" learning systems offer an interesting range of puzzles which, within the multi-layered presentations, offer a visual as well as a spelling lesson while having tremendous fun, and while, in fact, they learn that learning is really discovering the world around us, and that it really is great fun to learn! This offers individual students, or teachers of groups, a unique and powerful method of a rapid-results-learning-field which has the potential to dramatically change lives for the better. The important thing is to reach the child at a young age in order to condition him/her that learning is a great fun adventure, and easy. Common knowledge is that poverty conditions especially in third world countries tend to be a serious obstacle in the path of receiving a decent education. The opportunity which this product offers translates into huge potential for the economy of any country which deems education to be important, such as the USA and South Africa, but also in third world countries where education is lagging behind. Teachers in South Africa have seen the potential value for educating masses of children through this program and they are particularly excited about it. The Director General of Education in KwaZulu Natal, Dr Shabalala has commented: "This product is of vital importance. It helps to facilitate concept forming. This is a major problem at all age levels."

(1) Description of Related Art Including Information Disclosed Under 37 CFR 1.97 and 1.98

Provisional U.S. Patent US62/521,729: Filed by MHE Pieters on Jun. 19, 2017; Confirmation no. 7806. Non-Provisional USA Patent Application 15.988/185 filed on 24 May 2018, confirmation no. 7327.

BRIEF SUMMARY OF THE INVENTION

This invention relates to learning aids in the form of puzzles which are designed to teach persons of all ages, particularly children, various concepts such as reading and literacy, biology, history, anatomy, geography, religion, maths through the concept of tens and ones in a unique way and many other fields.

The application of the invention is unlimited. It is an object of the invention to provide learning aids in the form of puzzles which are fun to solve or play by old or young and which are educationally instructive and developmental to the builder. These educational aids lend themselves to be used in a 1:1 situation which means teacher or parent to child, or a teacher to group-of-learners-situation, or a group of learners by themselves, or one learner by him/herself. The child's natural voracious curiosity is fed by self-discovery, and because even the small child finds the models relatively easy to do, he/she will build the models repetitively-which adds the repetition aspect. This leads to a very positive self-image which carries lifelong benefits for the child and/or learner.

Research has shown that the learner's most receptive years are from birth to 4 years old.

The motive of this invention is to utilize this very important period, as the invention, which translates into a program of themes, is adapted to connect with, enhance, grow and develop with the child's environment, which starts with his/her mouth and progresses to his/her bedroom, to learning the concepts of numbers, to biology, geography etc. later in the child's development.

The unique relational function between the learning matter and the puzzle pieces or substrate needs to be very clearly emphasized. This functional relationship between the learning matter, which is represented by the printed pictures, words, numerals, and the carefully designed structure of the substrate, which is the material the physical model is made of, is the pivot and single most important aspect which guarantees the efficient absorption of the correct learning matter, which is the exact purpose behind the puzzle models.

The benefits of this functional relationship are that the learner discovers and thus UNDERSTANDS the correct answer through self-discovery, and self-correction. These benefits are of monumental importance and solves a multi-faceted problem in a world which is developing faster than teachers can cope with, coupled with the fact that there are far too many children who need education. There is simply not enough time to render individual attention. Four billion people are functionally illiterate today, which is the result of similar problems 20-40 years ago. This invention constitutes a contribution to alleviating this problem and need to be applied now in order to change the future.

There are seven ways in which this functional relationship operates, which are clearly described in the paragraph 0) DETAILED DESCRIPTION OF THE INVENTION paragraph below.

(i) BRIEF DESCRIPTION OF THE SEVERAL VIEWS OF THE DRAWING(S)

FIG. 1, FIG. 2, FIG. 3, FIG. 4, FIG. 5, FIG. 6 AND FIG. 7: Teaching basic reading skills and a great enjoyment of reading associated with learning the geography of objects by using the example of puzzles based on the face of a clown.

Figure 8A:
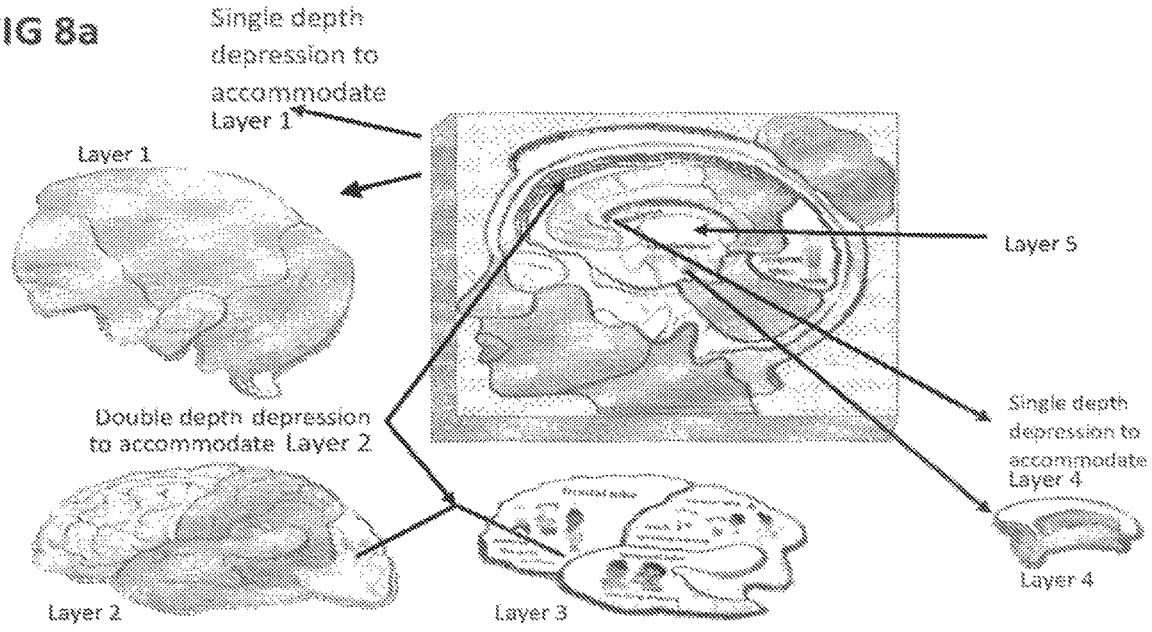
Figure 8B:
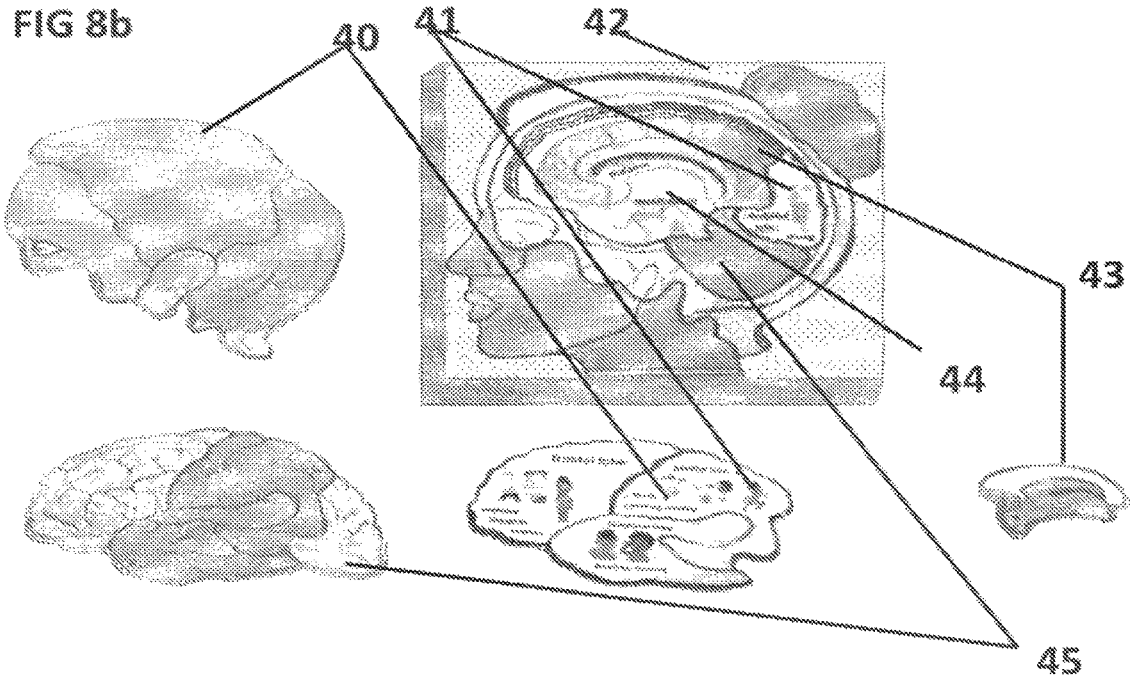

FIG. 8*a* and FIG. 8*b*: Embodiment of the invention through a composite, non-math puzzle model with associated information and descriptions, teaching in depth subject understanding, as well as reading skills, consisting of 5 layers.

Figure 8C:
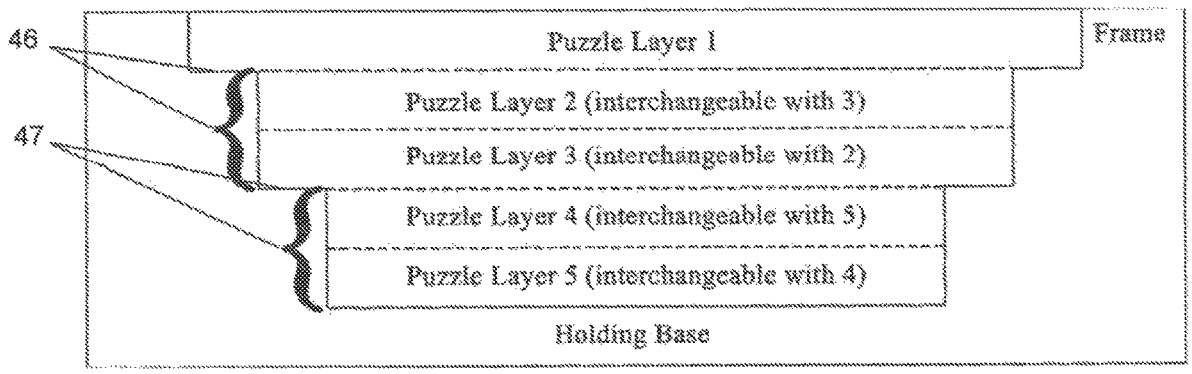

FIG. 8*c*: Cross-sectional view showing layers.

Figure 9:
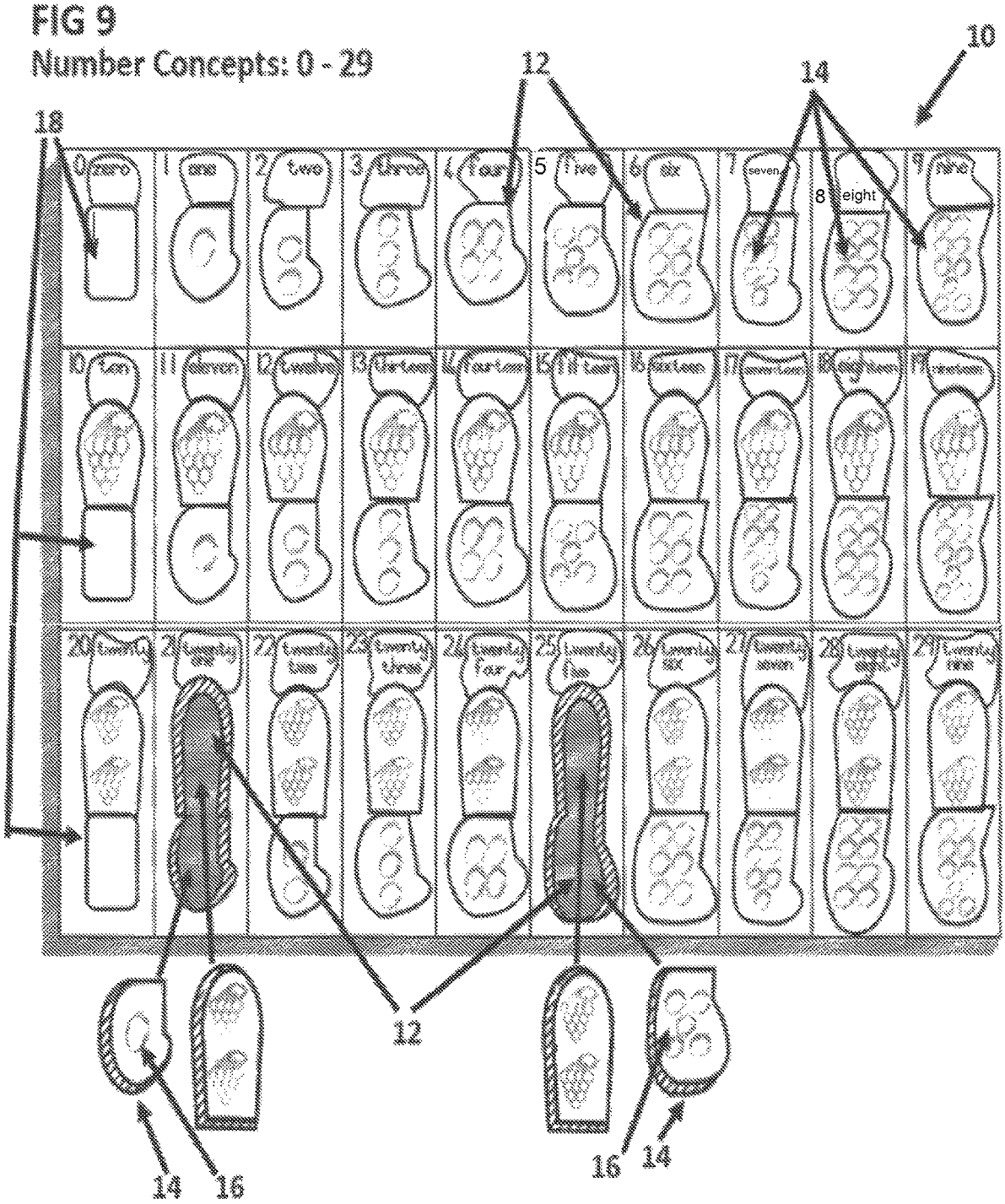
Figure 10:
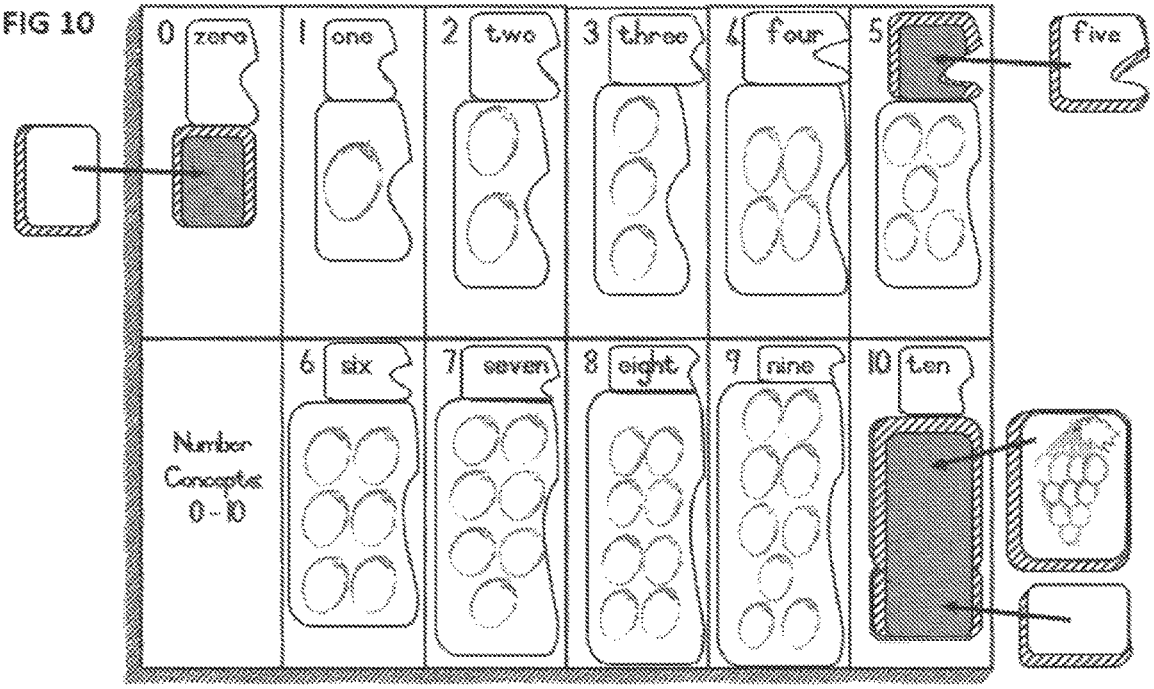
Figure 11:
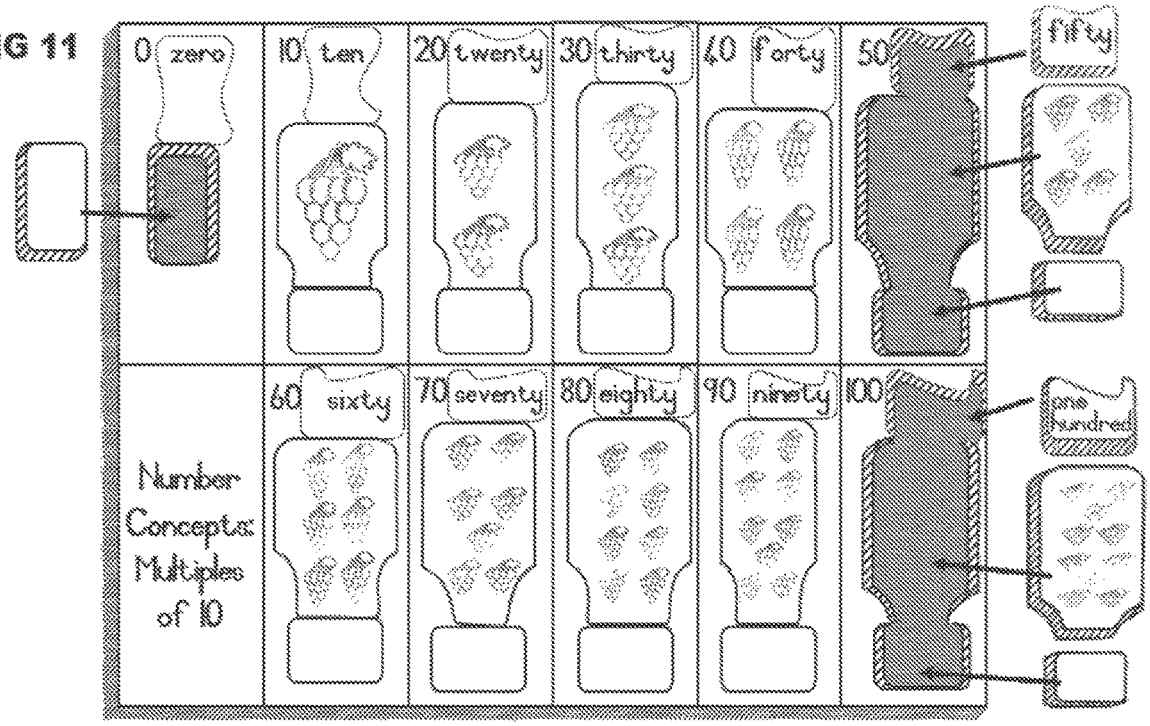

FIG. 9, FIG. 10, FIG. 11: Teaching the concepts of Numbers 0-29; 0-10; and Multiples of Ten respectively, using a bunch-able object known to all children like a bunch of grapes, plus learning to recognize or read the associated written word of the numerals.

Figure 12:
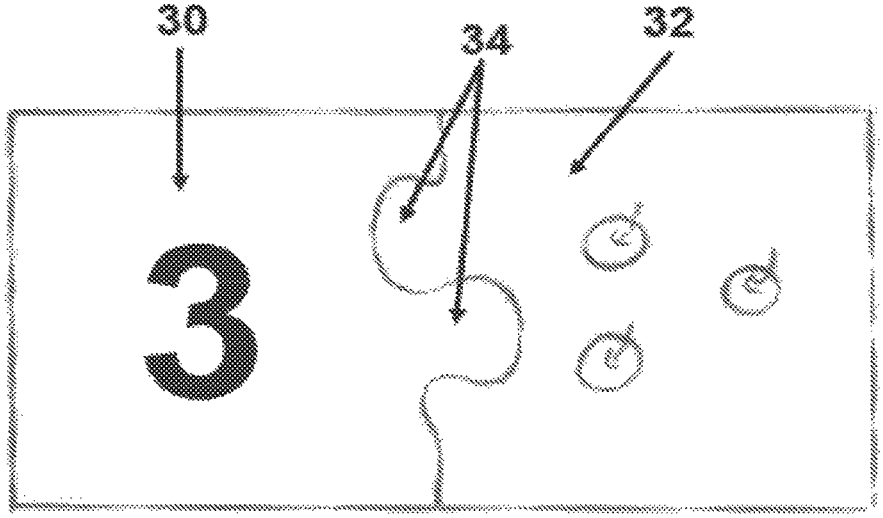
Figure 13:
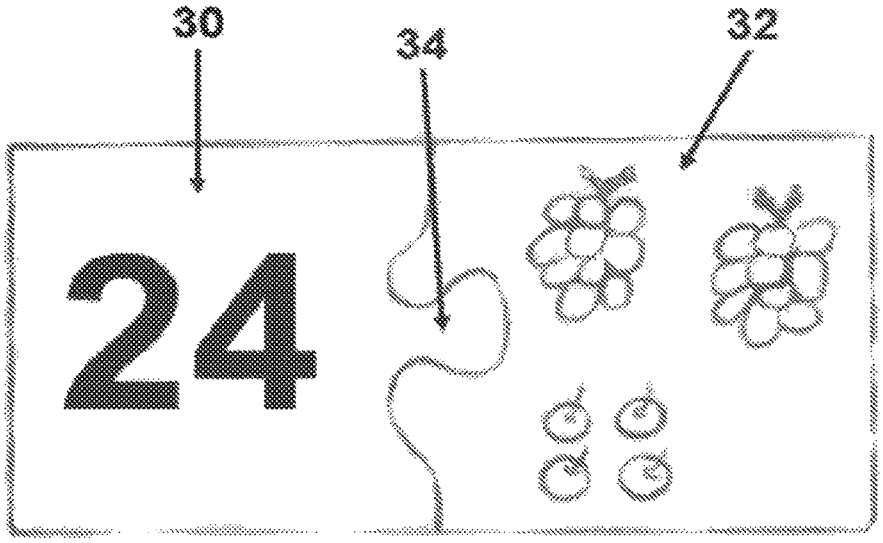

FIG. 12 and FIG. 13: Simple embodiment of the grapes-application of the invention in matching pairs.

Figure 14:
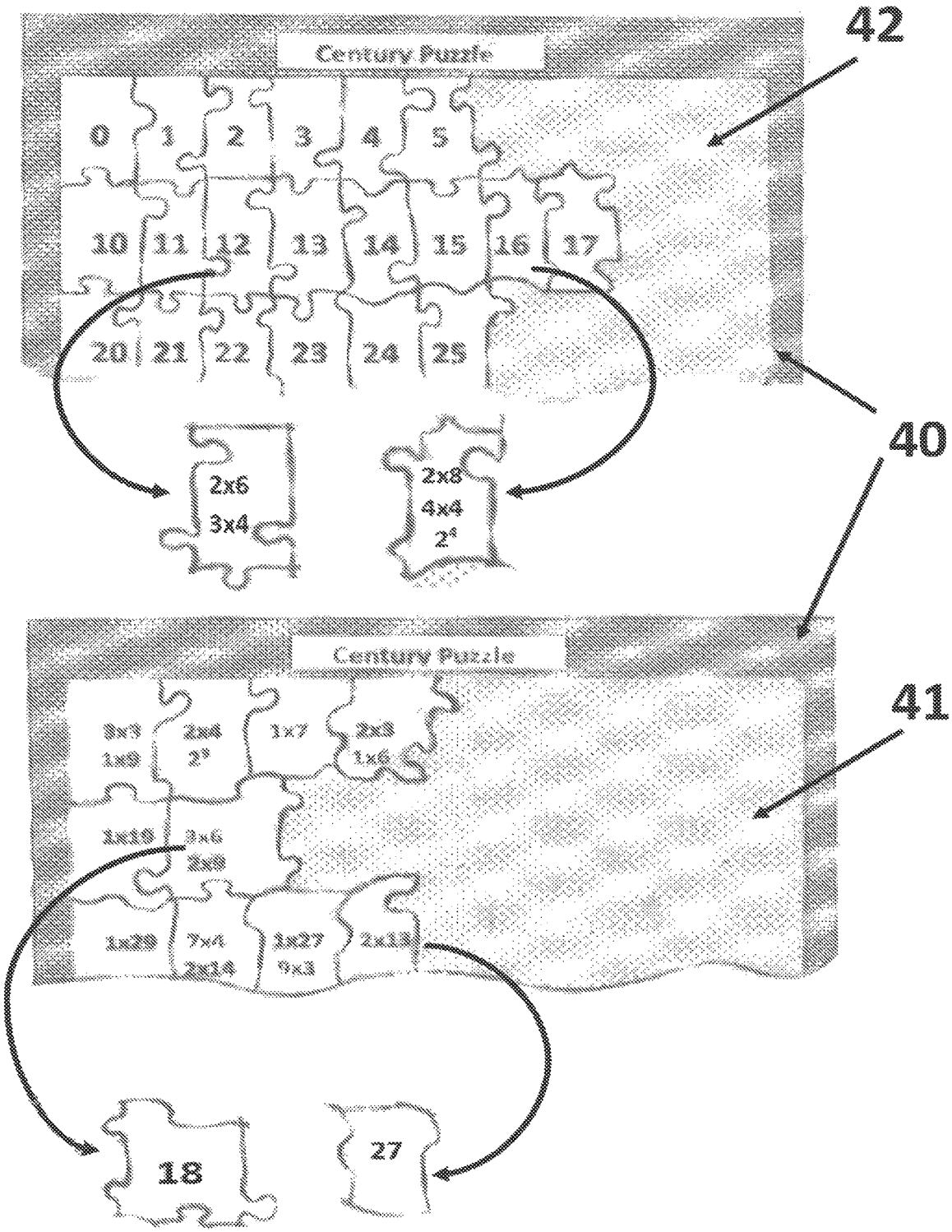

FIG. 14: Consolidation and continuance of understanding of the concepts of numbers O to 109, with associated factors like multiplication tables through the embodiment of the double sided, reversable puzzle invention called the Century Puzzle.

Figure 15:
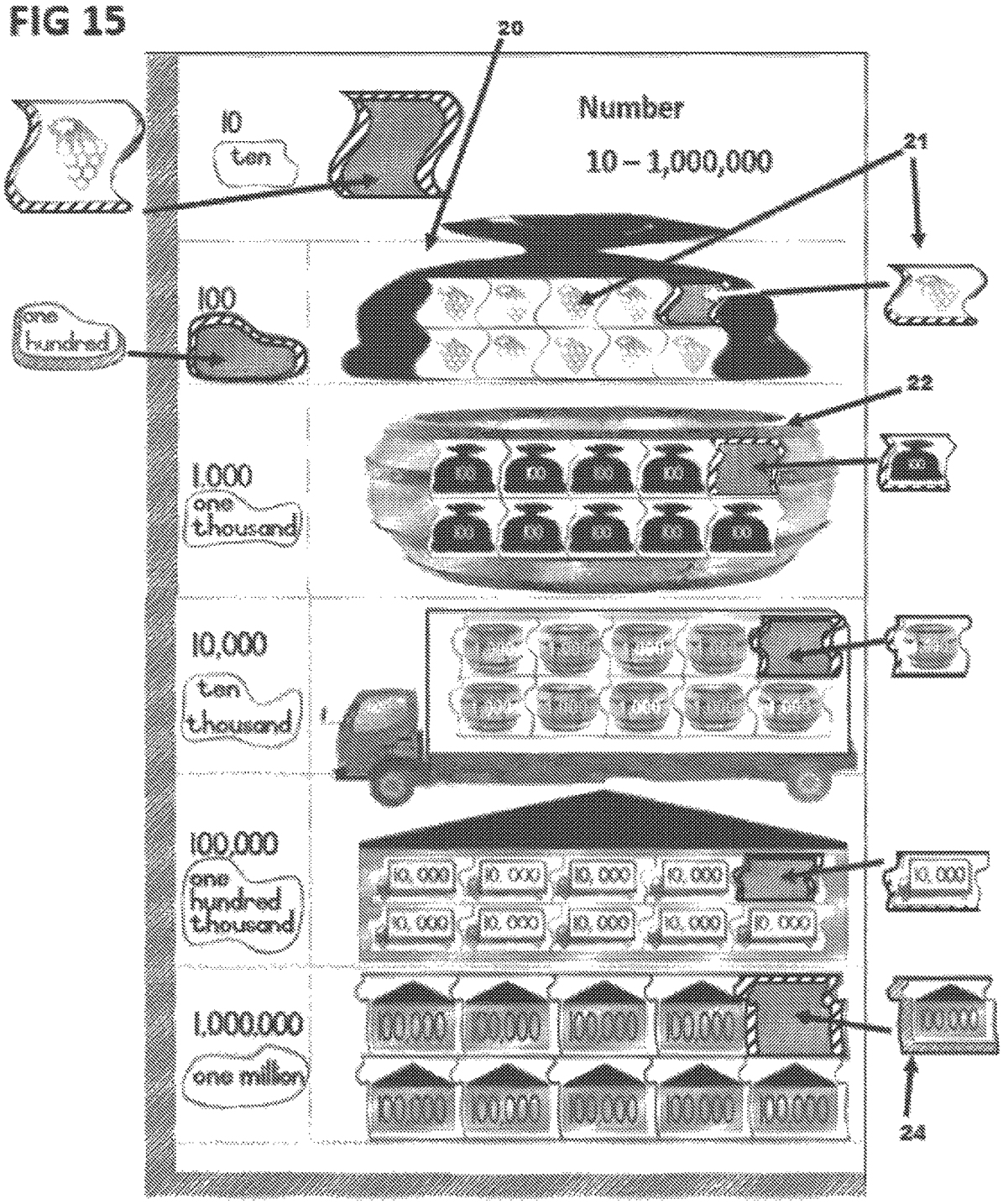

FIG. 15: Continuation of teaching the concept of numbers: 10 to 1,000,000, using a bunch—able object known to all children like a bunch of grapes, associated with learning to recognize the words of the numerals.

FIG. 16*a*: Embodiment of the invention through a composite, non-math, geography puzzle model consisting of 4 layers with legends and descriptions. Layers are indicated by:

First layer, at the top.

Second layer (Below first layer).

Third layer (Below second layer).

Fourth layer, at bottom (Below third layer).

FIG. 17: Example of table serving as Embodiment of list of puzzle themes derived from translating SA School Curriculum objectives into puzzle themes, illustrating the development in complexity which is commensurate with the school curriculum and the natural cognitive development of the learner. This illustrates how the local school curriculum will be analyzed and translated to puzzle themes for a puzzle program in every country where the invention will be made available.

(i) DETAILED DESCRIPTION OF THE INVENTION

Embodiments of the invention consist of a puzzle board which contains at least one first item or items, which include at least one formation in the form of a picture or part of a picture or a word or a numeral, and at least one or more second item or items. The second item/s having items which comprise or include complemental formations to the first item/s.

The first item contains predetermined or preselected concepts, and the second item/s displaying explanations, descriptions, amplifications or answers relative and/or complemental to the concepts represented by the first item/s. The first item may merely be a depression shaped like a familiar object such as a clown's face. The second item in this case therefore comprises the building of the face with all of its parts, plus the words naming the various parts of the face. It will be appreciated that the loose puzzle pieces may include both first and second items.

It will be appreciated that an entire embodiment of a puzzle model, consisting of all of its parts, including first and second items, may take the form of a map, the Periodic Table of Elements, the succession of State Presidents, Kings and Queens, correct moves in chess and far too many other applications to be listed in this specification.

A number of embodiments of the invention are described hereunder with reference to the accompanying drawings, all of which are plan views of various forms of the invention. It is emphasized that the descriptions below are only illustrative and in no way restrictive, as the invention lends itself to unlimited applications to every sphere of life and every subject under the sun.

The uniqueness and patentability of this invention resides in a number of uniquely designed functional relationships which operate in all of the Little Genius Producing puzzles invention.

Description of the vital functional relationship between the indicia represented by the printed matter, which constitutes the knowledge items and/or learning matter which the model is purposed to convey to the builder of the puzzle, and the designed structure of the substrate, which is the physical shape/s of the substrate which is represented by the designed shapes and/or depressions of the puzzle board and the physical shape/s of the loose puzzle pieces.

Every little part and shape of the substrate, from the reason why puzzles are used, to the design of the substrate, to the printed indicia and learning material, to the way the entire sequence in which the program of individual puzzles is planned, is carefully planned at drawing board stage to form an integrated program of learning. This makes the concept of the Little Genius Producing puzzle program a veritable applied science. The shapes which the board or substrate and the individual pieces are cut into depends entirely on the nature of the learning matter which the specific puzzle is purposed to convey and requires very careful planning. The design of the structure requires thorough understanding of the object of the puzzle, i.e., the knowledge and skill/s which the particular puzzle is purposed to convey, and the most effective and most un-obvious way to achieve it. The substrate or material used is furthermore very important indeed with respect to its properties and versatility to accommodate the design.

(a) Functional Relationship Design Number One: Thematical Structure of the Series as a Whole:

The structure of puzzles as the most effective vehicle to convey the learning material was selected for the purpose of this invention, because children have an insatiable appetite for building puzzles. Young children normally find puzzles relatively easy to build, as long as the particular model, at least initially, is commensurate with the child's level of cognitive development. The sequence of the themes in the series of puzzle models in this invention is specifically structured and programmed to meet, and follow, and then subtly and subconsciously, accelerate the child's natural cognitive development through utilizing and feeding the young child's natural, voracious curiosity. The thematical structure of the School curriculum is therefore utilized as authoritative guide in the on-going design of the thematical structure of the invention, with the result that the school's purposes are reflected, served, supported and enhanced.

The pattern of a child's cognitive development generally takes place as follows:

- The baby and young child's awareness of life starts with his/her mouth, where food is received.
- Then it progresses to awareness of mom, dad, siblings and pets.
- Next, the child becomes aware of his/her bedroom and surroundings, friends enter his/her world, then school and more.

This is therefore exactly the pattern of the thematical structure of the Little Genius programme. The puzzles initially

- Meet the 2 to 4-year old's level of cognitive development, but then
- Become more complex to build in terms of theme, as well as in the increasing number, but decreasing sizes of puzzle pieces.
- Some of the themes which progress in complexity following the child's natural development in the pattern described above, are in order of recommended use:
- Clownface: The child's entire awareness starts with his/her face, from where the world is observed, and from where he/she is fed: 14 large pieces per layer of 2 layers.
- My Family: which would include brothers, sisters, pets: 20 large pieces per layer of 2 layers.
- My Bedroom: The child's environmental awareness has now grown to include his/her bedroom with toys, bed and everything he has been observing there: 40 medium sized pieces per layer in 2 layers;
- My school: He/she starts school and meets friends, teachers, discipline etc.: 60 smaller sized pieces per layer of 2 or more layers.
- Activities we do in Summer, Fall, Winter, Spring: An embodiment which consists of the trajectory of the sun showing why summer is hot vs winter is cold, coupled with the appropriate activities pertaining to each season: 100 smaller pieces per layer of 4 layers,
- Progressing through learning to tell the time in digital as well as analogue format, learning basic mathematical concepts, through fractions, the table of elements, to the various aspects pertaining to the continents of the world, the political states of the world, the climatic regions, the population densities of the various countries and very many more. Even adults find these models extremely informative and enjoyable.

(b) Functional relationship Design number two: The role of repetition in the Little Genius Producing puzzles as a vital part of the vital functional relationship between the child with the level of cognitive development he/she is in, the learning material (which is represented by the indicia, which is embodied in the printed matter), and the substrate (which is the physical puzzle board with its depressions and the loose puzzle pieces) which the indicia are printed on:

- It has been proven that the way human beings, and therefore any young child, assimilate knowledge and skills is through association and repetition, which is the "mother of learning."
- The concept of the Little Genius Producing Puzzles described in this document make learning and self-discovery great fun and make it easy. Every normal child should love puzzles. The child initially finds the puzzle challenging to build, but subsequently is successful, which results in a feeling of accomplishment and the child building the puzzle repetitively, which adds the repetition component voluntarily.

Although cases do exist of children who do not love building puzzles, these are mostly because of negative experiences which are associated with building puzzles at some stage in the short life of the child, an example of which might be a caregiver or even mother of the child saying, "You are too dumb to do this".

(c) Functional relationship Design number three: A puzzle board contains the first predetermined item or items of learning materials (indicia or printed images) and irregularly shaped depressions. A plurality of loose puzzle pieces represents the second item or items with complimentary indicia (printed images). The structure of the substrate of each puzzle piece is designed to be complemental to ONLY fit into the correct depression/s which could be:

- the location on the puzzle board wherefrom the piece was cut at production stage, or it could be
- a depression or series of depressions designed and marked with indicia of the same numerical or mathematical value or an associated concept or concepts depending on the indicia on the puzzle piece.

The function of this designed functional relationship is to:

- guarantee the assimilation and association of correctly related first and second items, and therefore to prevent the learner/child from learning or associating incorrect first and second items.
- manifest and demonstrate the learner's and/or puzzle builder's possible erroneous and/or incorrect thinking, which gives teacher a clear indication of the educational intervention needed to correct the puzzle builder's thinking.
- render effective educational intervention to correct possible erroneous thinking demonstrated by the learner's and/or puzzle builder's unsuccessful building of the puzzle model, through the designed, self-corrective functional relationship operating in the puzzle model, which causes the learner to try-try-again to find the correct fit for a particular loose puzzle piece, until the correct depression on the puzzle board has been located and a perfect fit results. A perfect fit indicates that the correct facts have successfully been associated.

Under this heading, there are two types of designated shapes pertaining to the depressions and the loose puzzle pieces which fit into them a. As mentioned, certain depressions which are marked with the same value, and into which a selection of identically shaped puzzle pieces which carry indicia which are complimentary in value to the said set of depressions, are shaped identical.

b. However, the depressions which do not carry the same value, together with the loosed puzzle pieces that fit into them, are designed to be unique in shape, as are the depressions on the puzzle board, ALTHOUGH they are purposefully designed to appear deceivingly similar in shape to the naked eye, especially the inexperienced eye of the young child. The objective achieved by this function is to force the child or learner to compare and/or match the information (i.e. the indicia) on the puzzle piece with the information (i.e. the indicia) on the puzzle board, as opposed to comparing the shapes of the loose puzzle pieces with the shapes of the depressions in order to guess where the best fit would occur. By doing this, the child would be conducting "shape-comparison", which would mean that he/she would not be focusing on the learning content (the indicia), which is precisely what we want to avoid.

The shapes which the depressions on the substrate and the loose pieces are cut into, are not regular geometric shapes such as squares or circles or octagons, circles, pentagons, nonagons, triangles or any other related geometric or regular shape. Neither is it any other easily recognizable irregular shape of any kind such as a donkey with three heads or a dog's four legs or a camel with two humps, or the like. There is a very deliberately designed purpose for this: If the puzzle pieces were shaped into easily recognizable regular geometric shapes or into easily-recognizable-irregular shapes, such as mentioned above, the purpose of the puzzle model would be negated, because:

The answer to the question posed by the first item would be given away prematurely, so that the learner will not have learnt the lesson which is purposed by the puzzle model.

The learner would have done "shape comparison" by comparing the easily comparable geometrically- or irregularly shaped depression on the puzzle board, with the relatively easily recognizable geometrically- or even irregularly shaped puzzle piece, and would not have learnt the lesson which the information as per the indicia on the puzzle board and the puzzle pieces intended for him/her to learn. A tell-tale sign that the learner is doing "shape comparison" is if the learner tries to fit a piece into every depression in order to find a fit. This demonstrates his/her lack of understanding of the learning material represented by the indicia. The object of the puzzle model is not to do "shape comparison", but the object is for the builder to:

Compare the printed indicia on the puzzle pieces, to the printed indicia which are on the puzzle board;

Match the written word on a puzzle piece (for example "twenty-three") with the image it complements or refers to, which is on the puzzle board, which is the numeral "23";

Count the grapes on a puzzle piece and find the correctly matching numeral or word which is on the puzzle board, for example a loose puzzle piece containing the image of two bunches of 10 grapes each, and a third loose puzzle piece containing the image of three loose individual grapes, which refers to the numeral "23" on the puzzle board.

This will have the following effect:

Only if the learner/builder has the correct answer will he/she find the correct depression for a puzzle piece, causing the puzzle piece to fit perfectly. A perfect fit confirms the answer and affirms that effective learning has taken place.

The assimilation of the correct information is guaranteed because of this self-corrective method which provides the builder the needed affirmation of a correct answer and of a successful achievement.

This obviously facilitates learning through self-discovery trial and error but in a fun, encouraging and relaxed way.

If the learner tries to fit the piece in all the depressions in order to find the correct match, the teacher can readily observe the learner's erroneous thinking and thus identify exactly the educational intervention the learner needs.

A note on the design procedure of this designed functional relationship:

It is surprisingly difficult to design 12 different shapes which look so similar to the naked eye that you can't easily observe the difference. It is, however, an extremely difficult task to have all the loose puzzle pieces which carry the identical value, to perfectly fit into each other's depressions!

In the puzzle model Number concepts 0-29, (FIG. 9 of the drawings) there are 30 different shapes and depressions to be designed in this way:

one identical shape for each of the numerals smaller than 10. In this puzzle, there are three positions of each of the puzzle pieces which each has the image of a number smaller than 10 individual grapes on them, (i.e., the numbers "0,1,2,3,4,5,6,7,8,9"). As example please refer to number 18 on FIG. 9. For example, there are three positions for the loose puzzle piece with the image of 8 individual grapes on it, one position per line. Because these three puzzle pieces carry the identical value, they have to be able to fit PERFECTLY into any of the 3 depression positions marked with the numeral 8. The depressions have to be absolutely identical, and the 3 pieces which have the image of 8 individual grapes on them have to be absolutely identical in shape as well.

However, the puzzle piece with 8 loose grapes must NOT fit into the depression/s where, for example, the puzzle piece with 5 loose grapes on them, fit, BUT the two different shapes of the depressions must look very similar, BECAUSE we want the child to count the grapes, not compare the shapes of the puzzle pieces with the depressions in order to find a fit, as is the case with Klemm's disclosure.

This amounts to 30 loose pieces and 30 depressions which have to be designed and cut in groups of three identical designs each.

This is an extremely difficult task which require very careful design and cutting of the substrate, even using the extreme precise facility of laser cutting!

one identical shape for a single bunch of grapes. Keep in mind, in this puzzle there are ten positions where each of ten loose puzzle pieces, each with one bunch of grapes on them have to fit in perfectly, which means that all ten of these pieces have to fit perfectly into all ten depressions marked with a number between 10 and 19, inclusive, i.e. 10 pieces and 10 depressions are to be identical, and complemental. This is an extremely difficult task which require very careful design and cutting of the substrate, even using the extreme precise facility of laser cutting! See number 16 and 14 of FIG. 9 as example.

one identical shape for the pieces with two bunches of grapes on them. Keep in mind, in this puzzle there are ten positions where pieces with the image of two bunches of grapes on them, have to fit in PERFECTLY, which means that each one of all ten of these pieces, have to fit perfectly into all ten depressions marked with a number between 20 and 29, inclusive, i.e. 10 pieces and 10 depressions are to be identical and complemental. See number 16 and 14 of FIG. 9 as example.

All of the above, while the shapes of the depressions and loose pieces which carry dissimilar values, have to still appear similar to each other in shape, while they are so different that they do not fit into the incorrect position which is a depression. It is an equally difficult task to do the above designing while fitting into the aesthetics of the whole picture, as well as keeping the limitations of the type of substrate (e.g. wood, or Perspex, or cardboard) in mind.

These said shapes all require VERY careful planning at drawing board stage, then a sample needs to be manufactured to test shapes for efficacy and functionality, after which re-designing and re-cutting is needed until such time that the desired objectives in terms of the educational impact and value are achievable, namely: In building the puzzle, the child has to discover that the only way to find correct answer, i.e., to find the perfect fit, is to count the grapes and compare said number of grapes with the numeral/s with which the depression/s are marked. For example: What will fit into the depression marked "25"?

The child cannot easily compare the shapes of the loose pieces with the shapes of the depressions because all the pieces look pretty much the same shape, and all the depressions look pretty much the same shape. So: the child has to understand the digit "2" of the "25" refers to the puzzle pieces with two bunches of grapes on them, so that any loose puzzle piece with two bunches of grapes on it, will fit into the first depression in the block marked "25". Secondly, one loose puzzle piece with 5 individual grapes on it will fit into the remaining depression in the same block. The child will receive affirmation of a correct answer by achieving a perfect fit in every one of the pieces he/she has fitted.

(d) Functional Relationship Design Number Four:

This design of shaping the substrate does not include any regular geometric shape such as triangles, squares or octagons etc., or any other related geometric shape either. This design of shaping the puzzle pieces and the substrate into associative shapes pertains to learning to recognize words, that is, learning to read through repetitive association of the written word with the specific object and/or its natural outline, and does not involve any mathematical connotation.

In this instance, the puzzle piece which carries the part of the image of the nose (the first item), of e.g. a clown's face, which populates the first layer of a multilayer "reading" puzzle and the puzzle piece containing the word "nose" (the second item) which belongs to the next associative layer of the same puzzle embodiment which could have two, three or more layers of associated puzzles, and which are stacked vertically, constitute identical associative shapes.

The puzzle piece containing the object, that is, the face or part of the face, will as closely as possible follow the outline shape of that object, for example the clown's big round red nose. The shape of the puzzle piece which contains the word "nose" will have the identical shape as the puzzle piece which contains the picture of the nose, so as to facilitate easier association of the word "nose" with the image and shape of said nose. Due to subsequent successful building of the puzzle, the learner enjoys building the puzzles, and does this repetitively, which means that this association of the written word with the object is repeated and systematically assimilated in an relaxed and enjoyable experience, which translates into early and easy reading ability, which in turn leads to an early understanding of the world around the young child-learner, which facilitates the development of a high intelligence quotient.

(e) Functional Relationship Design Number Five:

A fifth type of planned and deliberately designed functional relationship exists between the subject matter of individual puzzle models (represented by the indicia and the printed matter on the puzzles), together with the designed structure of the substrate, and the continually progressive development of the young child as demonstrated in a multilayer embodiment of the invention. Each and every model has its very own requirements as far as the design of the substrate and the way it communicates with the indicia are concerned, as is demonstrated in the detailed description below. Please refer to FIG. 8*a* to FIG. 8*c* ("My wonderful Brain").

This design of functional relationship operating in the instant invention, is embodied in a multilayer embodiment of the invention. The top layer (first visible layer, or layer 1) of this design typically consists of a relatively simple puzzle but the individual puzzle layers get progressively more complex with every deeper layer. The child's cognitive development is matched at the first layer, but, subsequently, with every deeper layer, it is increasingly challenged and developed further. Examples of this functional relationship operating in multi-layer embodiments are "My wonderful Brain", "My Faithful Heart" and more. "My Wonderful Brain" may consist of 5 layers of individual puzzles. Please refer to FIGS. 8*a* and 8*b*, as the third embodiment of the invention.

The structure and cutting lines of the substrate and the positioning of the indicia (the items of knowledge which is the learning content) relative to the cutting lines are to be very carefully planned, designed, constructed and executed, then tested it for efficacy, and if needed re-planned, re-designed, and readjusted until the desired educational impact and results may be achieved, before production may take place.

The cutting lines are designed to be progressively smaller and narrower in both diameter and extremity periphery from the top layer to the deeper layers, but progressively increasing in complexity to build, from the top down to the bottom layers. This is to facilitate:

The individual puzzle pieces from the deeper layers have to be removable, and not get stuck underneath substrate overhangs from layers above, or the deeper layers will not work which will cause the learning contents to be in disarray, confusing and ineffective.

The learning contents represented by the indicia needs to progress in complexity from the top layer to the deeper layers, with the number of individual loose puzzle pieces increasing in number and decreasing in size, in order to systematically and imperceptibly increase the level of difficulty and challenge to the learner;

The voracious natural curiosity, enthusiasm and cognitive development of the child needs to be stimulated and maintained at its maximum for successful assimilation of the learning material indicated on deeper layers, down to the deepest layer.

It is necessary to describe this puzzle meticulously in order to understand the vital functional relationship between the designed indicia and the designed structure of the substrate, in order to facilitate clarity in this regard. Please refer to FIGS. 8*a* and 8*b*, as the third embodiment of the invention.

The top layer, Layer 1 number 42 (the outer puzzle board), and number 40 (the puzzle at layer 1) together, constitute a simple, 8-piece puzzle commensurate with the development level of a 3-year-old. It is a puzzle of the side view of a human face. We will call this an image puzzle, as it constitutes a puzzle of a picture or an image. A child of 3 is already familiar enough with the image of the human face to be able to manage layer 1, and for this reason, said layer 1 also constitutes an excellent introduction to the activity of building puzzles in the first place. As the top layer is taken apart, the second layer (layer 2 or number 45 of FIG. 8*a* and FIG. 8*b*) comes into view, which is another image puzzle, which the child now observes "incidentally". Layer 2 is the image of the white human facial skull with its mandible and teeth, plus the picture of the outside of the brain when the skull is removed. It shows the lobes of the brain, i.e. the frontal lobe, the parietal lobe, the occipital lobe etc. As the young learner is busy building layer 1 of the lady's face, he/she SEES the images on the next layer and is fascinated by this new image-puzzle. This fascinating discovery is henceforth, indelibly engraved into his/her mind to the point that he/she is excited to try his/her hand on building the latter puzzle as well. This demonstrates how the design of the physical structure of the entire puzzle model demonstrates the interactive functional relationship between the substrate's design and the printed matter/information presented by the puzzle model. Learning is facilitated and achieved through association and repetitive building of an interesting puzzle, through an ingeniously relaxed and enjoyable process, while feeding the child's voracious natural curiosity through self-discovery. An exemplary cross section showing layer 2 and layer 3 puzzle pieces being of the same perimeter and interchangeable is shown at 46, and also showing layer 4 and 5 puzzle pieces being of the same perimeter and interchangeable at 47.

The second layer is cut into smaller and more pieces, and the image, which is a picture of the skull and the brain, and which is cut according to the various brain lobes and skull bones, which the child learns is "inside" his/her own head, is more complex, so that it requires more adeptness and skill to build. There is absolutely no pressure from the parent on the child to build layer 2, the child only sees it at this stage. Once the child has successfully done layer 1, and he/she is keen to also break up layer 2 to build it, he/she should be allowed to do so. The child has therefore naturally progressed from the very simple layer 1 (40 and 42) to the more complex layer 2 (45), while his/her spatial coordination and cognitive skills in general are being increasingly stimulated, encouraged and supported by the designed structure of the substrate in interaction with the indicia (the learning content).

Please observe that the outer edges of the entire layer 2 (45) is smaller in size than that of layer 1(40). The purposes are:

- to ensure that layer 2 (45) will not fit into the position of layer 1(40), as that will cause confusion with respect to the learning contents of the two layers;
- to ensure that the individual pieces of layer 2 are removable and buildable, i.e., they do not get stuck underneath substrate overhangs from layer 1;
- to ensure that the child's cognitive development is progressively challenged by a slightly more complex puzzle with more complex pictures and concepts, and that the child's interest is therefore stimulated to its maximum throughout the building session.

The following stage would therefore be for layer number 2 to be removed as well, and Layer 1 and layer 2 to be built. This calls for strategy, as the builder has to build layer 2 first and then layer 1, because the depression which layer 2 fits into is narrower and smaller in diameter than that which layer 1, which is wider in extremity, periphery and diameter than layer 2, fits into.

The very moment layer 2 is removed in preparation to build it, layer 3 (or FIG. 8*b* number 41) automatically comes into view. Although to the builder of the puzzle this, again, seems "incidental", this surprise element is designed into the puzzle through the design of the structure of the substrate coupled with the increasing complexity of the learning material through more complex pictures and concepts presented by the printed matter on the substrate and puzzle pieces, all of which progressively challenges the child's cognitive development, keeping the child's enthusiasm at its maximum.

Layer 3 (41) consists of words and pictures describing the functions of the various lobes which is illustrated in layer 2. The associated function of every lobe is indicated by a picture as well as the appropriate words. In this way for example, the puzzle piece which is identical in shape and therefore associated with the piece in layer 2 which has the image of the parietal lobe on it, is the piece directly underneath the latter piece, and has tiny pictures on it of children touching each other, speaking to each other and a child running. The following words are associated and appear on the piece: "touch, speaking, running".

The careful planning and design of the cutting lines, which is responsible for the structure/s of the substrate and puzzle pieces, is done at drawing board stage and executed during production phase. Layer 3 had been designed to be cut together with layer 2 so that the puzzle pieces belonging to these two layers are identical in shape, fitting into the identical, now double thick depression. The cutting lines of layer 2 and 3 are according to irregular patterns, but generally follow the outline of the image printed on them, in order to:

- facilitate association with, and familiarity with the shape of the object printed on them, in this case the relevant lobe of the brain;
- facilitate association between the words and pictures on layer 3 with the relevant lobe/s pictured in layer 2, indicating the functions of the various lobes of the brain.

The object is for the child to observe, learn and assimilate in a relaxed and fun way:

- Through association of the identically cut pieces from layers 2 and 3, the child learns that the function of the parietal lobe, which is at the top of the head and which he/she also possesses, is to enable him/her to touch, speak and run. If the child cannot read yet, he/she will be able to recognize the activities of a particular lobe by the pictures which appear on the associated puzzle piece of layer 3.
- The child learns to recognize the written words for these actions by associating them with the accompanying pictures;
- This what his/her own head looks like on the inside.
- The same is applicable to all the other lobes as well.
- In addition to the above benefits, an additional functional relationship operates between the learning material and the design of the substrate as embodied in layers 2 and 3. Due to these two layers designed to be cut identically, they are interchangeable. Layer 2 may be built first and then layer 3, so that layer 2 occupies the position layer 3 normally occupies, and layer 2 is underneath layer 3. This enables the child to first build the lobes-picture, and then to concentrate on placing the functions of the lobes on top of the images of the respective relevant lobes. This facilitates learning both ways.

The stage following is when layer 3 is removed, in order to build it. At this time layer 4(FIG. 8*a* and FIG. 8*b* number 43) comes into view. Layer 4 is the image of the dissected human brain, showing all the relevant parts of the inner brain: the hippocampus, the corpus callossum, the cerebellum, the pituitary gland, etcetera. The extremities of layer 4 are cut to fit a smaller depression even than that of layers 2 and 3, so as to ensure that layer 4 is removable and the individual pieces do not get stuck underneath a substrate overhang from layer 2 or 3. The child's curiosity is stimulated and challenged as for the previous layers, and the same functional relationships apply. The moment layer 4 is broken up to be built, layer 5 (FIG. 8*a* and FIG. 8*b* number 44) comes into view automatically, which contains the names of the various parts of the dissected human brain. The latter two layers being identical in cut and substrate design, are interchangeable as is layers 2 and 3. The child learns what the inside of his/her own brain looks like and learns the names of the various parts and to read said names.

(g) Functional relationship Design number six. This functional relationship between the indicia which is the learning content, which represents item 1, and the designed structure of the substrate represented by the puzzle board, the 2 trays (also called lids) and the loose puzzle pieces as item 2, is demonstrated in a sixth embodiment of the invention, FIG. 14, entitled "Century Puzzle"

This embodiment relates to a board 40 on which a numeral sequence 0 to 109 is marked one numeral per loose puzzle piece of 109 puzzle pieces. The structure and cutlines are carefully planned and designed at the drawing board stage so that every single puzzle piece is unique in shape and fits ONLY in one specific position. This feature is also called being "self-corrective".

The substrate of this puzzle is uniquely designed to be double sided, i.e. to be turned upside down without disturbing the built puzzle, using two opposing trays, tray (or "lid") number one (41 of the drawing) to hold the built puzzle pieces when the numerals 0-109 are in view, and tray (or "lid") number two to hold the built puzzle pieces for when the reverse side of the puzzle pieces containing the numerals 0 to 109 are in view.

This puzzle model builds on the understanding of the concept of multidigit numbers as taught in the puzzle models with grapes. This puzzle model assumes that the learner has had the opportunity to do the number concepts O to 1,000,000 puzzle models featuring grapes, and now understands the concept of numbers all the way up to one million. The next step in development of complexity is to remove all references to grapes.

Firstly, the learner may now demonstrate understanding of the correct sequencing of numbers O to 109 by building the numbers only, in the correct sequence, without reference to the tens and ones referred to in the grapes-puzzle models, into tray (or "lid") number one. The learner observes the sequencing of numbers and realizes:

- every numeral has one specific place in sequence with other numerals as learnt in the Number Concept Puzzle models that use grapes to facilitate understanding of the numerals O to 1,000,000;
- every numeral has its one specifically designated place in nature, in a specific sequence with other numerals, exactly like each puzzle piece only fits into one specific position in this puzzle model described as being "self-corrective".
- Due to the arrangement of the numbers-indicia (which is item 1) in horizontal lines 0 to 9; 10 to 19; 20 to 29 and further to 109, with the tens in a vertical column from 0 to 100 on the left side of the puzzle model from top to bottom, plus many other patterns which become observable when the puzzle is being built, the child-learner discovers that numbers display and appear in patterns in nature.

Secondly, tray (or "lid") number two (42 of the drawing) is now placed on the face of the puzzle model in front of him/her, so that the numbers are obscured. Then the puzzle model as a whole is turned upside down, and tray ("lid") number two is now underneath the puzzle model. Tray ("lid") number one is now on top, obscuring the surface of the reverse side of the puzzle model. Tray one is then removed to reveal the reverse side of the puzzle pieces, which reveals the indicia which appear on this reverse side.

The indicia which are in view at this point may be any factor or aspect related to the numeral on the other side of the puzzle, for example, it may be the multiplication tables and factors pertaining to the numerals on the other side. Examples are:

The reverse of the puzzle piece with number 8 on it, may be marked with factors

"4+4
2×4
16+2
23
80+10"

The reverse of the puzzle piece with number 24 on it, may be marked with factors

"12+12
6×4
48+2"

The reverse of the puzzle piece with number 84 on it, may be marked with factors

"12×7
28×3"

Some of the discoveries and realizations which are made by the builder during the building of this double-sided puzzle model with its unique functional relationship design features described above are:

- the discovery that numbers display patterns in nature, which is a stimulation and encouragement to the young child or builder to delve deeper into mathematics. Some examples are the products of the ten times table appear in one straight vertical column; the products of the twelve times table go diagonally down; the fives do a half-row jump every time, and so on.
- Numbers are not complicated at all to understand, in truth they are fascinating, they are fun and they are conquerable;
- The puzzle model could be readily used in a fun group competition where a question is asked: "What is 12×7?" The correct answer is revealed when the puzzle piece marked with "12×7" is turned to its reverse side, to provide affirmation of the correct answer "84".
- It is also a great help when practicing to memorize multiplication tables and/or factors.

(h) Functional Relationship Design Number Seven.

A variation of the functional relationship design number four as applicable to a multi-layer word puzzle described in paragraph (d) above, is described in a fourth embodiment (FIG. 16) of the invention. In this designed functional relationship, all the layers have both words as well as images, similar to geographical maps. The indicia (learning content) is represented by the pictures and images of the various maps, which is item 1, and may consist of different aspects pertaining to conditions in a geographical area such as Africa. Four, or any number of, separate maps of Africa, of identical size of periphery, each containing one aspect, may form the puzzle model of Africa. For example:

- The top layer (layer 1): The map of Africa indicating the different states of Africa, each state in a different color code;
- The second layer (layer 2): The map of Africa indicating the physical aspects e.g. rivers, mountains, deserts, height above sea level etc., all in different color coded legends;
- The third layer (layer 3): The map of Africa indicating the different climatic regions in different color coded legends;
- The fourth layer (layer 4): The map of Africa indicating the populations densities in the various regions, in color coded legends.

All the above maps are individually marked with identifying descriptions and names of states, rivers, mountains, directly on the map layers.

The design of the structure of the substrate and the loose puzzle pieces describe below, represents item 2. Item 2 therefore consists of the tray holding all of the different maps of Africa as layers of puzzles, stacked vertically, so that a particular region of Africa, e.g. the state of *Niger*, is always in the same vertical location relative to the holding tray, which means that if the puzzle piece containing the state of *Niger* is lifted, the next layer down (layer 2) will show the *Niger* river, the Air mountains and the Sahara desert which take up portions of that state. When these pieces are lifted, the desert climate of *Niger* in its color coding is visible on the next layer down (layer 3). When the puzzle pieces containing the color coding of the Sahara Desert is lifted, the color coded population density of *Niger* is visible on the next layer down (layer 4).

The designed cut lines of each layer depends on its learning contents represented by the printed matter which is called the indicia (item 1). The cut lines generally follow the color coded demarcations so that, for example, the red color code of the Sahara Desert takes up its own individual puzzle piece. The builder observes and assimilate the shape of the Sahara Desert, and that it stretches across a number of African states. Climatic regions which often occur together in nature, may be grouped together on the same puzzle piece, so that the builder learns to associate these climatic regions. The physical size of the puzzle piece is of importance also, because a too small puzzle piece is non-sensical. The same applies to the design of the shapes of the puzzle pieces containing images of the rivers and the mountains, coupled with the resulting height above sea level. The same applies to the color coded map of the population density regions. This map is at the very bottom of the stack of layers, due to the fact that all the other aspects influence human activity in any region. It is the human activity which is the ultimate object of our interest. When the puzzle piece/s containing the physical aspects of *Niger* is lifted, the color coded map of population distribution of *Niger* shows the population as less than 10 per square km.

The benefit of an embodiment such as this is that the information on the various layers pertaining to any particular country or area on the map/s give insight about the particular country. By building the layer of, e.g., the Sahara Desert on top of the map of the population density, the builder comes to realize that the reason for the very sparse population density is that the area is a desert, or the reason why there are so few souls living in the Himalaya area, is because the mountain is covered in ice, because the Himalayas is the highest point above sea level on earth. This embodiment would be suitable for use in High School up to grade 12, and even beyond.

The design of the structure of this puzzle model will be a very intricate operation, which will require initial planning, cutting and testing, then re-planning, cutting and testing until the substrate structure supports and achieves the desired educational impact and objectives. The design of this functional relationship between item 1 and item 2 in this puzzle model is of pivotal importance in the eventual success with which the builder of the layers of this puzzle model will observe the various causative aspects as applicable on the African continent, and the subsequent consequences and level of understanding of why the human activities are the way they are.

Of great importance in the design of the puzzle pieces which plays a vital role in the aesthetics of the final puzzle model as a whole, is also the properties of the substrate in terms of how it can be shaped, for example wood vs Perspex vs cardboard.

(i) Some Examples of Embodiments of the Invention

The first example of an embodiment of the invention, is the "One-Layer Word-Puzzles": This embodiment of the invention is illustrated in FIG. 1, FIG. 2 and FIG. 3.

The board 60 has a depression 61 as the clown's head.

Figure 2:
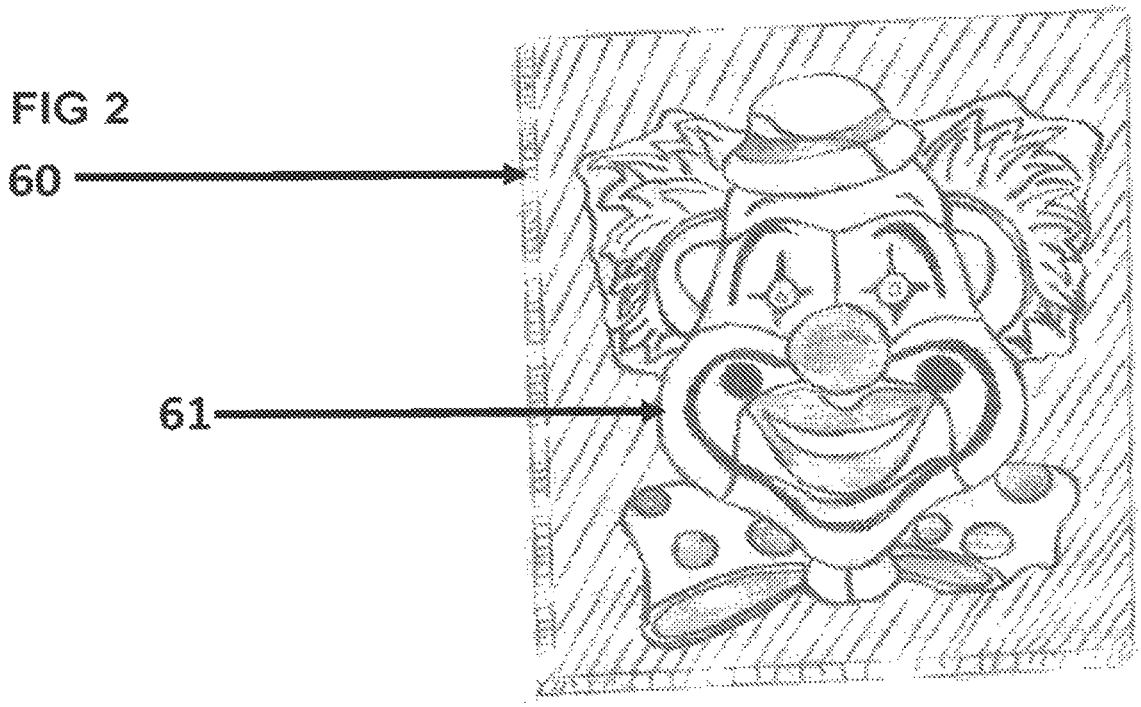
Figure 3:
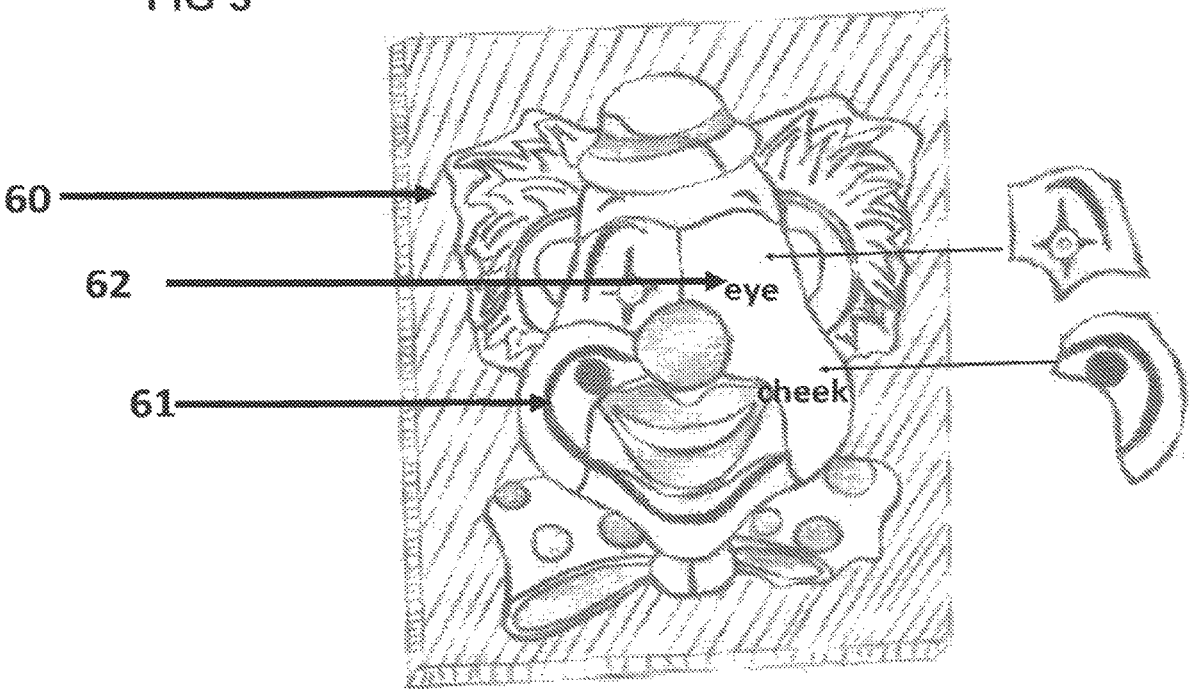
Figure 4:
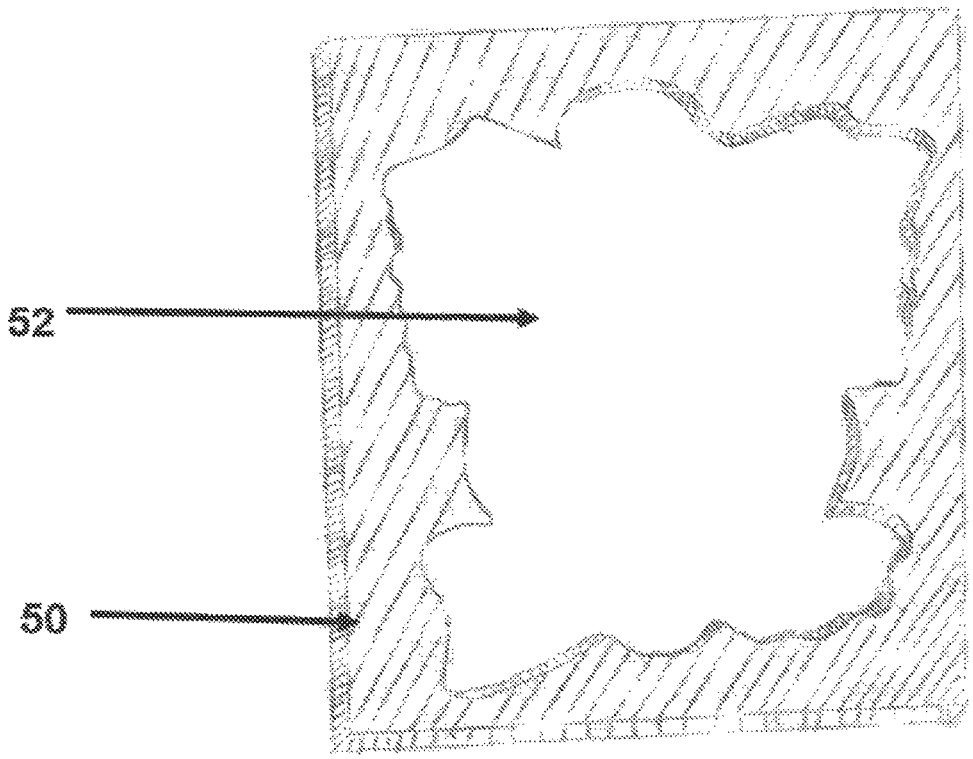

In FIG. 2 and FIG. 3 various loose pieces are placed in the only positions possible to complete the face as in FIG. 2 In FIG. 1 and FIG. 3 the unremovable base of the puzzle 62 is shown, marked with the names of the various parts of the face in any one specific language of choice, in their appropriate positions so as to line up vertically with the position of the individual puzzle piece bearing the image of the part of the face described by the particular name on the base of the puzzle model.

The pieces shown in FIG. 2 and FIG. 3 are then superimposed thereon. It is emphasized that the above descriptions are only illustrative and in no way restrictive, as the invention lends itself to unlimited applications.

In the "One-Layer Word-Puzzle," a large depression may be provided, which is complemental and corresponding to the puzzle of e.g. the image of a clown's face (which had been cut therefrom, and which we will call an image-puzzle). The loose pieces of this image-puzzle collectively form the same shape as the depression and can thus only fit into the depression at its predetermined correct place.

The said depression is marked on the unremovable base of the puzzle with the names of the various parts of the face appearing in the clown's face image-puzzle. These names are marked in the exact suitable areas which correspond, in vertical position aspect, to the relevant part of the image on the image-puzzle piece it describes, e.g. the nose or the chin of the clown. The word therefore has an explanatory, identification and descriptive function to the relevant part of the image concerned. Because the positions of the various puzzle pieces bearing the image or part of the image on the image-puzzle correspond with the position of the relevant words on the base, the learner discovers that the nose, chin, ear, or shape of the nose, chin or ear is called and spelled NOSE, CHIN or EAR, as applicable.

Although collectively the puzzle pieces of the image-puzzle fit snugly into the depression from whence it was cut, each individual part of the image-puzzle (meaning, every part of the face of the clown) occupies its own piece. i.e. the image of the nose occupies one piece, the image of the chin occupies one piece and so on. The function of this is so the child at three years old will get to know the geography or layout of the human face and will be able to relate to the contents, because his/her own face is structured in the very same pattern. The shape that the individual pieces are cut into embodies a further functional relationship between the learning content or the image on it and the shape which the substrate, i.e. the puzzle piece/s were designed and cut into at production stage. Although the puzzle pieces are cut according to irregular shapes and NOT regular geometric shapes, they follow the outlines of the image of the object that occupies it. The learner therefore learns to recognize the physical outline or shape of the nose or the chin or the forehead, the shape of the ears and so on.

A further functional relation operates in this puzzle. Should the builder incorrectly select the position of the relevant word on the base, e.g. reads the word "cheek" as to be "nose" and tries to match e.g. the puzzle piece containing the image of the nose with the incorrect word, the puzzle will not work out. When he/she finds the correct relevant word and fits the correct relevant puzzle piece with the correspondingly relevant image on top of the correct word, the puzzle will work and the association of the written word "nose" with the image as well as the shape of the nose, will be established and repeated, depending on the number of times the puzzle is built repetitively. Again, the many aspects of the functional relationships between the images, the learning material or printed matter on the substrate and the shapes which the substrate is designed and cut into, facilitates the objective and method of the Little Genius Producing Puzzles, which is to attract the learner to play with the puzzle repetitively in order to learn rapidly and independently through ASSOCIATION AND REPETITION WHICH IS THE MOTHER OF LEARNING.

Some of the skills imparted:

The functional relationship between the image on the image-puzzle and the words on the base which operates through the structure of the shape that the depression is cut into, and the positions which the image-puzzle pieces fit into, all of which causes the said image and the said word to be associated with each other, actually imparts the vital skill of word recognition, or better described as the skill of reading, even without the participation of a teacher.

Secondly: A very important aspect in education is that education without interaction can never be successful. Integration of imagination, hand-eye coordination, spatial relational recognition and comprehension are involved simultaneously as the learner utilizes and develops these faculties in building the Little Genius Producing puzzle model.

Thirdly, social interaction is achieved through more than one learner building the puzzle together in the same session, which builds social skills in an age where computers have a negative impact on social skills. The infamous "screen-culture" of our age, which is deemed to only worsen with the development of technology. The Little Genius Producing Puzzles invention concept therefore creates the very important balance between computer activity and social skills.

A second preferred embodiment example of the invention is the "Two- or Multi-Layered Word Puzzles":

In this embodiment of the invention, the base of the depression described in the previous embodiment, which has words printed on it, is also cut into an independent puzzle layer. We will call this a "word-puzzle". The entire puzzle model therefore consists of two layers of puzzles, both fitting into the same depression, plus a base which holds the entire puzzle model together. The said base of this depression may be devoid of any description, and the depression is now of double depth in order to accommodate the two layers of puzzles. This double-thick depression was in actual fact caused by cutting the two puzzle layers from it. The positions of the puzzle pieces containing the names of the parts of the face are in corresponding positions to the image(s) on the image-puzzle they describe, similar to the "One-Layer Word-Puzzles," described above. The only difference is that the words are now also cut into a puzzle.

This embodiment is illustrated in FIG. 4 to FIG. 7. Starting with FIG. 4 the board 50 has a double thick depression 52 in the shape of the clown's head.

Figure 5:
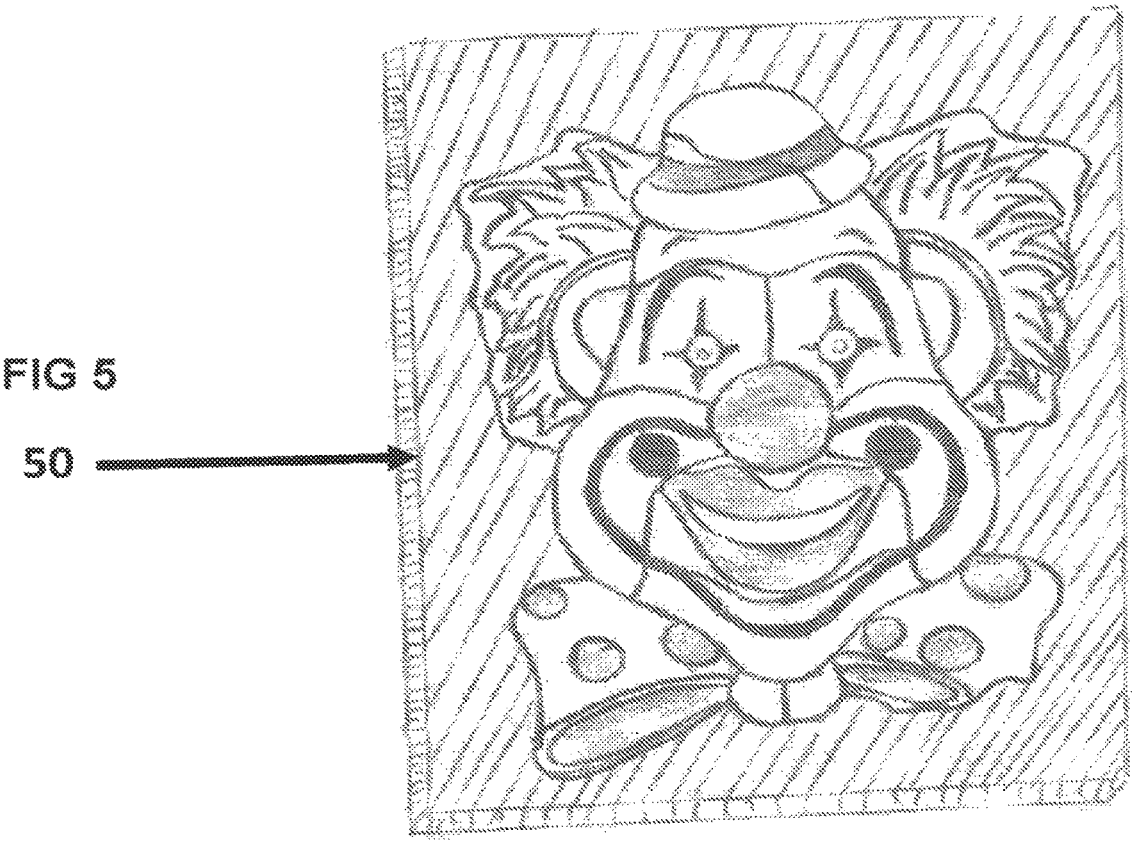
Figure 6:
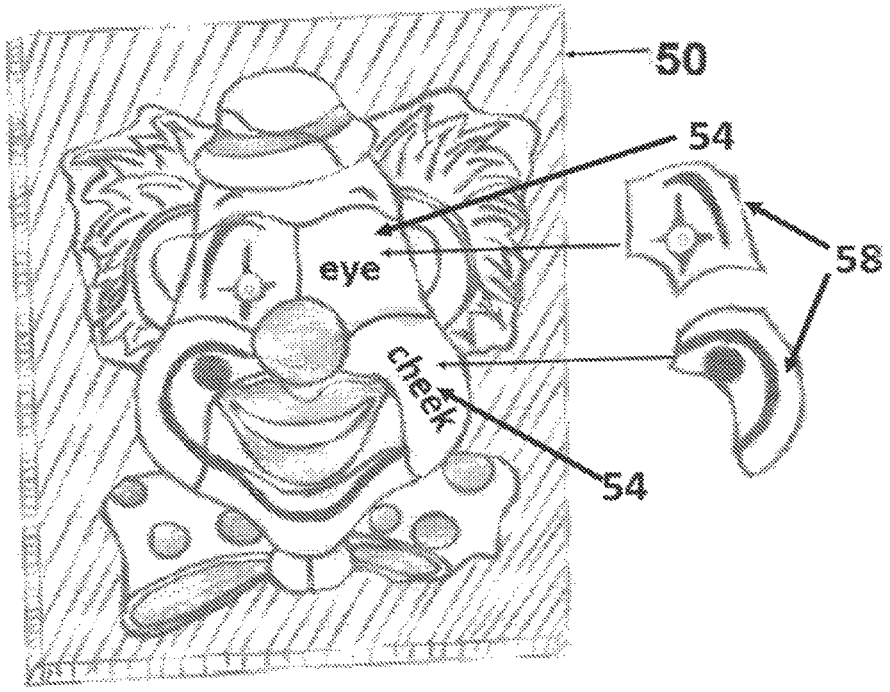

In FIG. 5 and FIG. 6 various loose pieces are placed in the only positions possible to complete the face as in FIG. 5.

Figure 7:
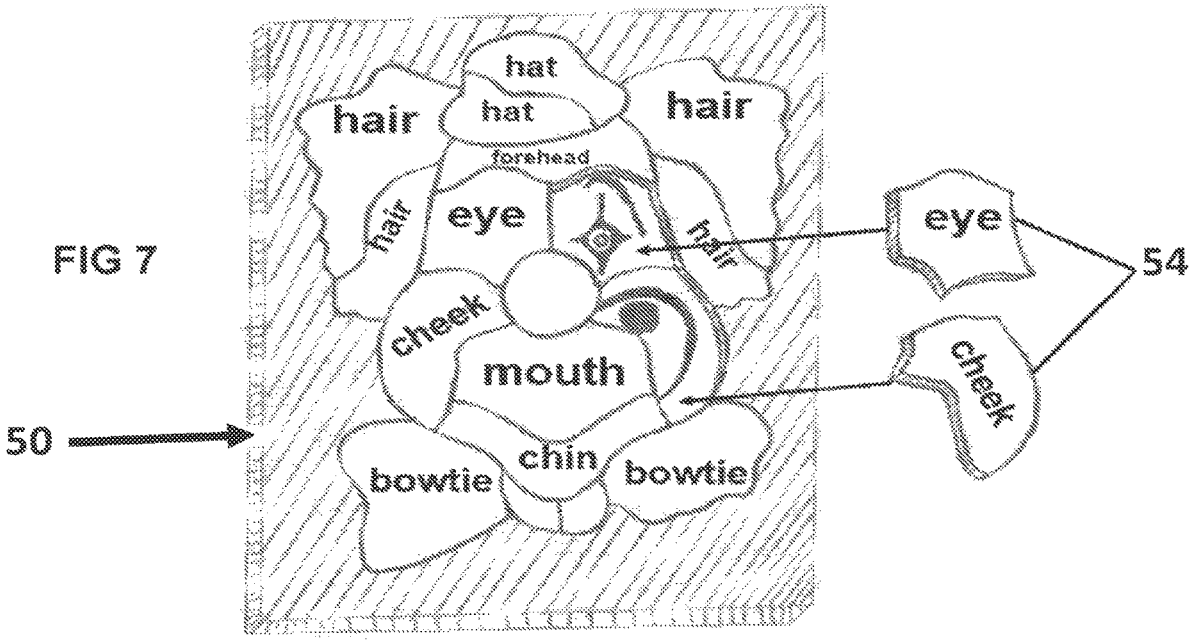

In FIG. 7 another set of loose pieces 54 is shown, each marked with the name of the particular portion of the face. These pieces are first located in the only possible positions and then the pieces 58 shown in FIG. 6 are superimposed thereon.

The layers may of course be in reverse order also, as in FIG. 7, which will mean that the picture layer may be at the bottom, while the word layer is built on top.

In another example a third layer, fourth layer and more may be added into the same puzzle, each layer bearing the names of the parts of the face in a different language and in a different color, even up to 11 languages, representing for example all the official languages spoken in South Africa.

It is emphasized that the above descriptions are only illustrative and in no way restrictive, as the invention lends itself to unlimited applications.

It will also be appreciated that an infinite variety of puzzles themes may be provided without departing from the scope and spirit of the invention which is claimed in the appended claims.

During the structural design phase, puzzle pieces and their word counterparts e.g. the piece containing the picture of the nose is designed to be cut together with the puzzle piece which contains the word "nose", into irregularly shaped pieces (i.e., not geometric shaped) but identical shapes, and following the outline of the image object so described. This reflects a further functional relationship between the learning content, which is the images and the words printed on the puzzle pieces which is also known as the indicia, and the structure of the substrate, i.e. the puzzle pieces and the board. Although the puzzle pieces are cut according to irregular shapes, they follow the outlines of the image of the object described by it and which occupies it or to which it refers, as closely as possible. The learner therefore learns to recognize the physical outline or shape of the nose or the chin or the forehead, etc. This facilitates association of the image with the name of the part of the face which is on the corresponding puzzle piece in the word-puzzle, and therefore facilitates word recognition. Word recognition is of vital importance at the earliest age possible, exactly because the earlier the child can read, it means he/she develops earlier understanding of the world around him/her, which increases his/her intelligence quotient as early as possible. Should the learner mistake the word "cheek" as to be "nose" and tries to match the puzzle piece containing the word "nose" with the image of the cheek, which is on a piece of the image puzzle, the puzzle will not work out. The learner does not need a teacher to point that out, he/she discovers that fact for him/herself. When he/she finds the correct relevant word and fits the correct relevant puzzle piece with the correspondingly relevant image on top of it, the puzzle will work and the association of the written word "nose" with the image as well as the shape of the nose, will be established and repeated, depending on the number of times the puzzle is built repetitively. The many aspects of the functional relationships between the images which is the learning material also called the printed matter or indicia on, and the shapes which the substrate is cut into, facilitates the modus operandi and objective of the Little Genius Producing Puzzles, which is to attract the learner to play with the puzzle repetitively in order to learn rapidly and independently through ASSOCIATION AND REPETITION WHICH IS THE MOTHER OF LEARNING.

A Word-Puzzle may contain many layers, some of which may not contain words but only pictures, and some layers which may contain both words or descriptions and pictures. The application of this unique concept is unlimited. It can readily be applied to biology, geography, the table of elements, historical events, or to any subject under the sun. If we take the example of the biological puzzle model of the human brain, entitled "My wonderful brain" (FIG. 8*a* and FIG. 8*b*), we see that this constitutes a third embodiment of the invention. This multi-layer word-puzzle consist of at least 5 layers of puzzles plus a base. Please refer to the paragraph Description of the vital functional relationship between the indicia represented by the printed matter, which constitutes the knowledge items and/or learning matter which the model is purposed to convey to the builder of the puzzle, and the designed structure of the substrate, which is the physical shape/s of the substrate which is represented by the designed shapes and/or depressions of the puzzle board and the physical shape/s of the loose puzzle pieces and subparagraph (e) above.

Models which contain word layers, can always be used as Reading-Puzzles" by which to teach word recognition (reading skills), even to illiterate adults. Very young learners can relatively easily learn to recognize technical terms of a wide variety, even at an age which would astonish any teacher, exactly because of the self-discovery aspect.

A third embodiment of the invention is described in paragraph (e) above, which describes the 5-layered "My Wonderful Brain". Refer to FIG. 8*a* and FIG. 8*b*.

Figure 16:
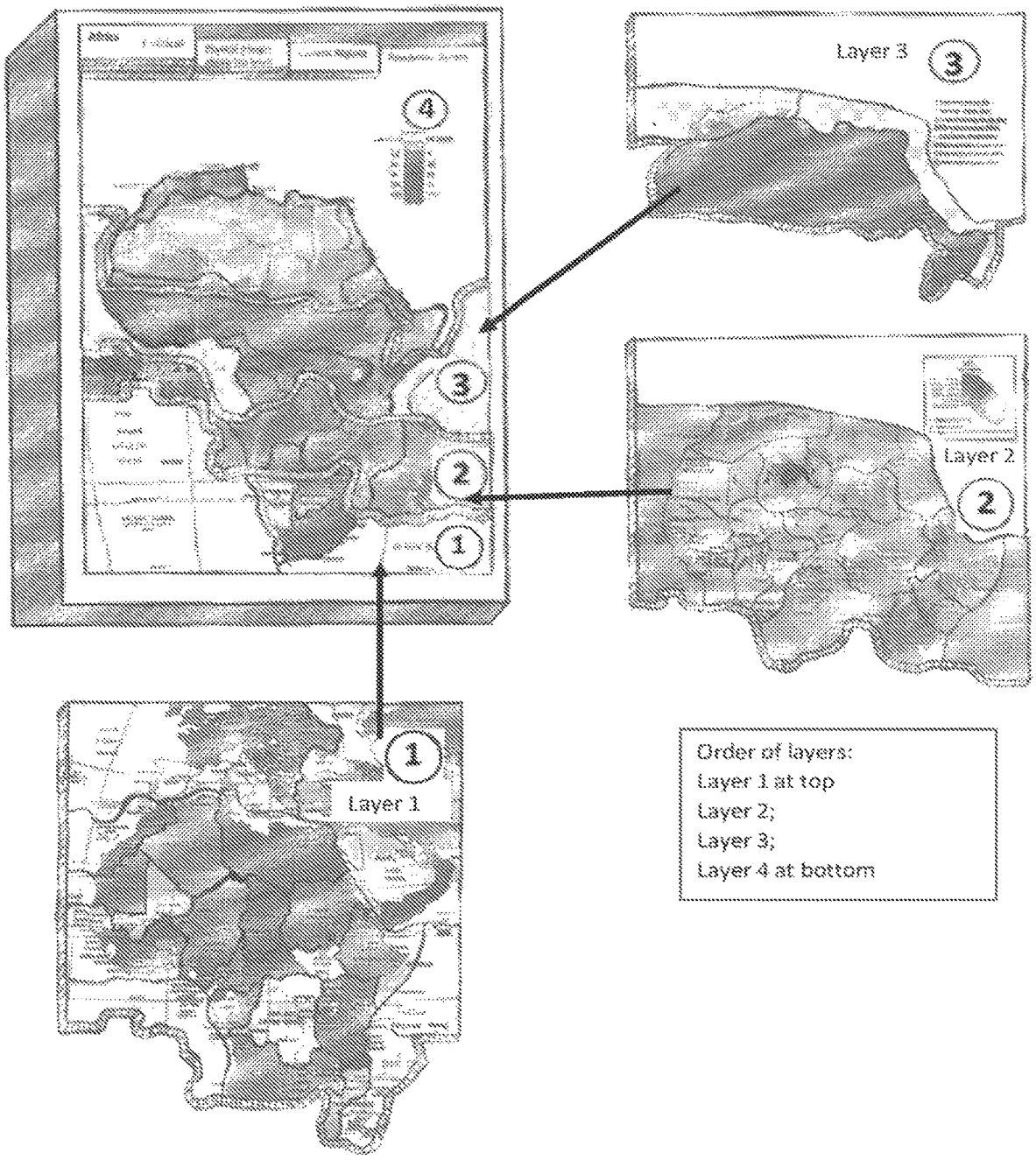

In a fourth embodiment FIG. 16 of the invention, a Word-Puzzle may also consist of layers which have both words as well as images, similar to geographical maps, with the expressed difference that it is used as a puzzle model or a multi-layer puzzle, all of which are layered on top of one another, The positions of the various parts like the continent of Australia, South Africa, etc. will corresponding vertically, as is described in previous paragraphs. The benefit of an embodiment such as this is that the information on the various layers all pertain to the same country or area on the map and give insight about the particular country. By building the layers of, e.g. the Sahara Desert on top of each other, the builder comes to realize that the reason for the very sparse population density is that the area is a desert, or the reason why there are so few people living in the Himalaya area is because the mountain is covered in ice. And is the highest point above sea level on earth. This embodiment would be suitable for use in High School up to grade 12, and even beyond. The description of the functional relationship design of this puzzle model is at paragraph (h) above.

In a fifth embodiment of the invention, the concept of the Little Genius Producing Puzzles can be readily applied to teach maths, e.g., the concept of multidigit numbers all the way up to 1,000,000, fractions, how borrowing & lending works when you're doing any numerical transaction, multiplication tables, and many more. This is done, amongst others, applying the already existing concept of TENS AND ONES in a unique method to convey or cause the child to learn and understand the concept of multidigit numerals using the illustration of grapes, in conjunction with the very effective functional relationship and communication between the learning contents which is represented by the printed indicia on the substrate i.e. the puzzle board and loose puzzle pieces, and the designed structure of the puzzle board and the loose pieces. The printed indicia which consists of the numerals and the depressions on the puzzle board represent the first item, while the printed indicia which consists of the images of the grapes and the words, together with the structure of the loose puzzle pieces, represent the second item in this embodiment.

The reason for grapes as indicia illustration, is that every child on earth, even in the poorest third world countries, is familiar with grapes. It is of central importance to use an image/object which already forms part of the learner's known environment, i.e. clearly understood by the learner, in order to convey a new concept, i.e., BEFORE effective absorption and assimilation of a new concept can take place. All children are also familiar with the appearance of grapes in bunches, and these bunches already form a very tight unit in their minds. The advantages of the bunch are that the builder does not have to count the number of grapes in the bunch every time. He/she has already counted the grapes inside the bunch a number of times, and he/she therefore already knows from experience that there are 10 grapes in the bunch and that this can be broken into separate individual grapes. (Other bunch-able fruit/vegetables like cherries and bananas could also be used effectively in the same manner that grapes are used in the Little Genius Producing Puzzles.) A number of preferred applications are described in the following paragraphs.

In this fifth embodiment of the invention, we have the first item consisting of a puzzle board which may be marked with numerals for example "0" to "10" or "0" to "29" as well as the words "zero" to "ten" or "zero" to "twenty-nine"; or "10" "ten" to "1,000,000" "one million" and a series of depressions. These depressions are designed to be similarly shaped to the naked eye, especially to the naked eye of the inexperienced young child, BUT these depressions are all different. These depressions are of irregular shape, which means there is no recognizable regular or geometrically shaped depressions such as squares, pentagons, octagons etc. The images on the puzzle pieces constitute the embodiment of the correspondingly valued numeral and words which are on the board, in grapes. The individual puzzle pieces with the images they carry, therefore are complemental to the numerals and words and the depressions on the puzzle board. The cutting lines are pre-designed to ensure a puzzle piece will only fit into the specific depression/s from whence it was cut, and/or into a depression which is marked with the same value as in the picture on the puzzle piece.

This relationship GUARANTEES the success of teaching the concept of the numbers involved, due to the following:

1. The shapes of the puzzle pieces are irregular but similar looking. There is more than one objective behind this. The depressions and the pieces are NOT of regular geometric shapes like squares or circles or octagons because the intention of the puzzle otherwise be negated, exactly because the learner would be comparing the easily recognizable shape of the puzzle piece with the easily recognizable shape of the depression, so that the learner would be doing "shape comparison" instead of counting the number of grapes:(e.g. two bunches with ten grapes each in it, and nine loose grapes) on the puzzle piece and comparing that to the depression on the puzzle board which is marked with the correct multi-digital number, namely 29. Remember that the express intention of the puzzle is that the learner learns, through self-discovery, what the meaning is of TWO TENS AND NINE ONES, and that he/she will NOT learn the incorrect answer through doing "shape comparison."

If the learner is trying all the depressions to a find a fit, it is clear that he/she is engaged in "shape-comparison" instead of counting grapes and in so doing, the type of assistance the learner needs is completely evident. In actual fact, the puzzle itself is self-correcting, and will therefore correct the learner's incorrect thinking, because a piece will not fit into an incorrect depression.

This functional relationship therefore:

2. Helps to IDENTIFY incorrect thinking on the part of the learner, which can then be corrected by the teacher.
3. The functional relationship GUARANTEES that the learner cannot make a mistake and learn incorrectly but will learn and understand the correct value of the numeral, because he/she is forced to match the numeral with the correct number of grapes/combinations of individual grapes and bunches of grapes for the puzzle to work out.
4. At the same time of learning the concept of the numbers, the learner learns to RECOGNISE the numeral AND associate it with the written word for it, i.e. learning to read as well, because the numeral appears in written word on individual loose puzzle pieces, which only fit into the unique but deceivingly similar-looking depressions whence they were cut from. Not only does the learner learn the concept of the multidigit numeral, but he/she also learns to read and correctly spell the word describing the numeral, e.g. "fifteen" or "twenty-five" or "twenty-nine."

This concept is different to every prior art because would be entirely impractical and ridiculous to have a puzzle piece cut with 29 sides as in the case of a particular prior art instance. (Please note shape recognition is obviously an important part of the foundation phase of a child and is also the theme of a Little Genius model. However, shape recognition is NOT the object here. The object here is to help the child understand the concept of complex MULTIDIGIT NUMBERS up to and including 1,000,000.)

This fifth preferred embodiment of the invention is illustrated in FIGS. 9, 10, 11 and 12. In FIG. 9 a puzzle board 10 is shown which has three rows of numerals and depressions 12 associated with each numeral and written word for the numeral. It will be noted that the depressions in the first horizontal row are all of differing shapes and sizes and correspond to loose pieces which have the correct number of grapes 16 or the like. The individual puzzle pieces which are carefully designed to fit its appropriate depressions, have the images of the respectively relevant number of loose grapes on them, for example the zero piece 18 has no grapes and only fits into the depression marked zero, and the piece with five grapes only fits into the depression marked "5 five".

The second row of the puzzle may commence with demarcated blocks, each marked with numbers 10(ten), proceeding to the number 19 (nineteen). The individual puzzle pieces which are carefully designed and adapted to fit the appropriate depressions at numbers 10(ten) to 19 (nineteen), have the images of the respectively relevant number of bunched and loose grapes on them, i.e.:

Any one of ten identically shaped loose puzzle pieces each with the indicia of ten grapes enclosed in a bunch on it, will fit into the larger depression in any of the blocks in the row. This bunch of grapes will refer to the digit "1" of the "10", or the"1" of the "15" or the "1" of the "19".

There will be a second depression in the block marked 10(ten), which has exactly the same shape as the loose piece 18 corresponding to zero, and which also will fit here. The numeral "10" is therefore explained by one (1) bunch with ten (10) grapes in it, and 0 (zero) loose ones.

The next block in the same row will have the number 11 (eleven). The individual puzzle pieces which are carefully designed and adapted to fit the appropriate depressions at number 11(eleven), have the images of the respectively relevant number of bunched and loose grapes on them, i.e.:

Any one of ten identically shaped loose puzzle pieces each with the indicia of ten grapes enclosed in a bunch on it, will fit into the larger depression in any of the to the blocks in the row, including this one. This bunch of grapes will refer to the digit "1" of the "11".

There will be a second depression in the same block, which has exactly the same shape as the loose piece corresponding to 1 (one) in the first row, and which also will fit here. The numeral "11" is therefore explained by one (1) bunch with ten (10) grapes and 1(one) loose individual grape kernel.

The next block down i.e. the second block in the third line will have the number 21 (twenty-one). The individual puzzle pieces which are carefully designed and adapted to fit the appropriate depressions at number 21(twenty-one), have the images of the respectively relevant number of bunched and loose grapes on them, i.e.:

Any one of ten loose puzzle pieces each with twenty grapes enclosed in two bunches each with 10 grapes on it, will fit into any of the large depressions in this third row. This piece with two bunches of ten grapes each on it, will refer to the digit "2" of the "21".

There will be a second depression in the same block, which has exactly the same shape as the loose piece corresponding to 1 (one) in the first line, and which also will fit here. The numeral "21" is therefore explained by two (2) bunches with ten (10) grapes each and 1(one) loose one.

Notice that all puzzle pieces that carry the same value fit into their communally shared depressions: for example, all pieces with 3 grapes on them fit into each other's depressions; all pieces with two bunches of grapes on them fit into each other's depressions and so on. Twenties and successive multiples of ten are treated in the same way and the board can be increased at will. FIG. 10 and FIG. 11 are related ways to teach the numbers 0 to 10, and the multiples of 10, respectively.

The concept of hundreds and thousands and millions may be similarly dealt with, using a puzzle board of FIG. 15, marked with numerals as well as words 10(ten) to 1,000, 000(one million) and a series of depressions, together with a plurality of loose puzzle pieces. In the first line, the concept of ten consisting of a bunch with ten grapes in it is established, in continuation of the design used in FIGS. 9, 10 and 11.

In the second line, a black bag is pictured with ten depressions in it. Ten identical loose puzzle pieces each marked with an identical bunch of 10 grapes fit into these depressions. The numeral "100" marks the depression on the board, with a loose piece with the written word "one hundred" on it which fits into this depression.

In the third line, a barrel is pictured with 10 depressions in it. The loose puzzle pieces which fit into these depressions are each marked with a black bag each with ten bunches of grapes in it.

The numeral "1,000"marks the depression on the board, and a loose piece with the written word "one thousand" fits into this depression.

In the fourth line, a delivery truck is pictured with 10 depressions in it. The loose puzzle pieces which fit into these depressions are each marked with a barrel with ten black bags each with 1000 grapes in it.

The numeral "10,000" marks the depression on the board, and the loose piece which fit into this depression is marked with the written word "ten thousand"

In the fifth line, a warehouse is pictured with 10 depressions in it. The loose puzzle pieces which fit into these depressions are each marked with a truck each with 10,000 grapes in it. The numeral "100,000" marks the depression on the board, and the loose piece which fit into this depression is marked with the written word "one hundred thousand".

The sixth line contains 10 depressions in it. The loose puzzle pieces which fit into these depressions are each marked with a warehouse with 100,000 grapes in it. The numeral "1,000,000" marks the depression on the board, and the loose piece which fit into this depression is marked with the written word "one million".

The above embodiment should be read together with paragraph (i) DETAILED DESCRIPTION OF THE INVENTION and Subparagraph (c) Functional Relationship Design Number Three The claims pertaining to the puzzles which deals with learning the concept of numbers are mostly centered on the following:

1. The uniquely designed functional relationships between item 1, the indicia which is the printed matter, which is the knowledge which the puzzle is purposed to convey, also called the learning content, and item 2 which is the designed structure of the substrate which consists of the puzzle board with depressions and the various self-correcting shapes of the puzzle pieces. These functional relationship/s constitute a unique development and method of employing a bunch-able fruit like grapes in order to convey the concept of complex, multi-digit numbers all the way up to 1,000,000.
3. The in-built GUARANTEE for the great success in conveying the learning material to the learner, exactly because a puzzle piece will ONLY fit in the designated, self-correcting shaped depression/s. It, therefore, PREVENTS the learner from learning the incorrect facts.

In a sixth embodiment of the invention, FIG. 14, relates to a board 40 on which a numeral sequence 0 to 109 is marked and a number of loose pieces 42 are provided. This embodiment has many unobvious features:

1. At this juncture the learner understands the concept of numbers all the way up to one million. The next step in development of complexity is to remove all references to grapes. The learner has to demonstrate understanding by correctly sequencing all numbers O to 109. Again, a puzzle piece only fits in one specific place, which it had been designed to do at the drawing board stage, so that the learner realizes every numeral has its one designated place in sequence with other numerals, exactly like each puzzle piece only fits into one specific position.
2. The learner discovers the patterns which characterize numbers on display: the tens are in one straight vertical line; the twelves go diagonally down; the fives do a half-line jump every time, and so on.
3. A further educative resource is the multiplication tables and factors which appear on the reverse side of every piece.

The substrate of this puzzle is uniquely designed to be turned upside down using two opposing trays, one for the front side when the numerals O-109 are in view, and one for the reverse side of the puzzle, when the numerals O to 109 are reverse side up. Turning the model reverse side up, the multiplication tables and factors pertaining to the numeral are in view. Thus, loose pieces marked "4+4, 2×4, 16+2, $2^3$, or 80+1O" all fit onto the reverse side of the puzzle piece marked 8.

This embodiment should be read together with (i) DETAILED DESCRIPTION OF THE INVENTION and subparagraph (c) Functional relationship Design number six.

In a seventh embodiment of the invention. This embodiment relates to the application of all aspects of the invention to the School Curriculum, which is to be applied to school curriculums the world over, especially to school curriculums belonging to third world countries, where poverty and lack of education abound.

The objective: To restore and feed learners' voracious natural curiosity, enjoyment of learning through self-discovery, assistance in rapid learning, counteracting negative experiences with respect to learning and learning problems, restoring good self-image and facilitating good educational future.

FIG. 17 embodies an example list of puzzle themes identified through analysis of the South African School curriculum ("CAPS" [Curriculum and Policy Statement"]) Foundation Phase to grade 3.

All drawings of embodiments included herewith are examples of puzzle themes as denoted by FIG. 17.

The invention claimed is:

1. An educational jigsaw puzzle comprising:

a board defining a first upper layer puzzle perimeter, a second layer puzzle perimeter below the first upper layer puzzle perimeter, wherein the second layer puzzle perimeter is smaller than the first upper layer puzzle perimeter, and a third layer puzzle perimeter below the second layer puzzle perimeter which is the same as the second layer puzzle perimeter;

a plurality of first layer puzzle pieces shaped to fit together and fitted together, the fitted together plurality of first layer puzzle pieces having an outer perimeter matching the first upper layer puzzle perimeter defined by the board;

a plurality of second layer puzzle pieces shaped to fit together and fitted together, the fitted together plurality of second layer puzzle pieces having an outer perimeter matching the second layer puzzle perimeter defined by the board and the third layer puzzle perimeter defined by the board;

a plurality of third layer puzzle pieces shaped to fit together and fitted together, the fitted together plurality of third layer puzzle pieces having an outer perimeter matching the second layer puzzle perimeter and the third layer puzzle perimeter defined by the board;

wherein a shape of each one of the plurality of second layer puzzle pieces matches a shape of one of the plurality of third layer puzzle pieces, wherein one of the plurality of third layer puzzle pieces are interchangeable with one of the plurality of second layer puzzle pieces;

wherein each of the plurality of second layer puzzle pieces and plurality of third layer puzzle pieces have an image or word printed on a top surface, and wherein each has a shape approximately corresponding to the shape of the image.

2. The educational jigsaw puzzle of claim 1 wherein the board further defines a fourth layer below the third layer puzzle perimeter, the fourth layer having a fourth layer puzzle perimeter which is smaller than the third layer puzzle perimeter.

3. The educational jigsaw puzzle of claim 2 further comprising a plurality of fourth layer puzzle pieces shaped to fit together and fitted together, the fitted together plurality of fourth layer puzzle pieces having an outer perimeter matching the fourth layer puzzle perimeter defined by the board, the plurality of fourth layer puzzle pieces being greater in number than the plurality of third layer puzzle pieces.

4. The educational jigsaw puzzle of claim 1 wherein the image or word printed on a top surface of the plurality of second layer puzzle pieces is an image, and wherein the image or word printed on a top surface of the plurality of third layer puzzle pieces is a word.

* * * * *